US009478207B1

(12) United States Patent
Micek

(10) Patent No.: US 9,478,207 B1
(45) Date of Patent: Oct. 25, 2016

(54) REVERSING CONFIGURATION CONTROL FOR STRING INSTRUMENTS

(71) Applicant: Petr Micek, Baltimore, MD (US)

(72) Inventor: Petr Micek, Baltimore, MD (US)

( * ) Notice: Subject to any disclaimer, the term of this patent is extended or adjusted under 35 U.S.C. 154(b) by 0 days.

(21) Appl. No.: 15/002,601

(22) Filed: Jan. 21, 2016

(51) Int. Cl.
*G10H 1/18* (2006.01)
*G10H 3/12* (2006.01)
*G10H 3/18* (2006.01)

(52) U.S. Cl.
CPC ..... *G10H 3/182* (2013.01)

(58) Field of Classification Search
CPC ..... G10H 3/182
USPC ..... 84/742
See application file for complete search history.

(56) References Cited

U.S. PATENT DOCUMENTS

| | | | | |
|---|---|---|---|---|
| 2,897,709 | A | 8/1959 | McCarty et al. | |
| 3,472,943 | A | 10/1969 | Kawabata et al. | |
| 3,544,696 | A | 12/1970 | Broussard | |
| 3,603,713 | A | 9/1971 | Nakada | |
| 3,663,735 | A | 5/1972 | Evans | |
| 4,222,301 | A | 9/1980 | Valdez | |
| 4,281,573 | A | 8/1981 | Yarema | |
| 4,405,832 | A | 9/1983 | Sondermeyer | |
| 4,423,654 | A | 1/1984 | Yamagami | |
| 4,480,520 | A * | 11/1984 | Gold | G10H 3/182 84/735 |
| 4,532,847 | A | 8/1985 | Youngblood | |
| 4,581,974 | A | 4/1986 | Fender | |
| 4,581,975 | A | 4/1986 | Fender | |
| 4,819,537 | A | 4/1989 | Hayes et al. | |
| 5,136,918 | A | 8/1992 | Riboloff | |
| 5,311,806 | A | 5/1994 | Riboloff | |
| 5,569,038 | A | 10/1996 | Tubman et al. | |
| 5,761,316 | A | 6/1998 | Pritchard | |
| 5,932,827 | A | 8/1999 | Osborne et al. | |
| 6,121,537 | A | 9/2000 | Pawar et al. | |
| 6,998,529 | B2 | 2/2006 | Wnorowski | |
| 7,115,810 | B2 | 10/2006 | Ambrosino | |
| 7,271,332 | B2 | 9/2007 | Clark | |
| 7,304,232 | B1 | 12/2007 | Nicholes | |
| 7,601,908 | B2 | 10/2009 | Ambrosino | |
| 7,674,991 | B2 | 3/2010 | Baird et al. | |
| 7,982,123 | B2 | 7/2011 | Mulvany | |
| 8,253,007 | B1 | 8/2012 | Steinberger | |
| 8,324,495 | B2 | 12/2012 | Jacob | |

(Continued)

FOREIGN PATENT DOCUMENTS

| | | | |
|---|---|---|---|
| GB | 2207542 | A | 2/1989 |
| GB | 2235562 | A | 3/1991 |
| WO | 92/13337 | A1 | 8/1992 |

*Primary Examiner* — Jeffrey Donels
(74) *Attorney, Agent, or Firm* — Rosenberg, Klein & Lee

(57) ABSTRACT

A reversing configuration control for string instruments connects to a pair of pickup coils located on a string instrument for selectively electrically configuring and blending the outputs of the pickup coils. The reversing configuration control includes a pair of potentiometers mechanically coupled for concurrent mechanical travel of the respective displaceable contacts thereof. The pair of potentiometers are operatively coupled to the pair of pickup coils and a pair of output terminals to vary the electrical configuration of the pair of pickup coils between (a) the pair of pickup coils being coupled with like polarity in one of series or parallel with respect to the output terminals, or (b) effectively coupling only one of the pair of pickup coils to the output terminals, or (c) the pair of pickup coils being coupled with opposing polarity in one of series or parallel with respect to the output terminals.

21 Claims, 14 Drawing Sheets

(56) References Cited

U.S. PATENT DOCUMENTS

| | | | | |
|---|---|---|---|---|
| 8,940,993 | B1 * | 1/2015 | Micek | G10H 3/186 84/725 |
| 2002/0073829 | A1 | 6/2002 | Gaglio | |
| 2002/0073830 | A1 | 6/2002 | Petherick | |
| 2003/0145715 | A1 * | 8/2003 | Wnorowski | G10H 3/186 84/726 |
| 2004/0159225 | A1 | 8/2004 | Barr | |
| 2006/0156912 | A1 * | 7/2006 | Annis | G10H 1/08 84/742 |
| 2009/0308233 | A1 | 12/2009 | Jacob | |
| 2010/0282046 | A1 | 11/2010 | Crocker | |
| 2010/0307325 | A1 | 12/2010 | Appel | |
| 2011/0017048 | A1 | 1/2011 | Bos | |
| 2011/0219942 | A1 | 9/2011 | Robertson | |
| 2011/0259180 | A1 | 10/2011 | Gournis | |
| 2014/0219477 | A1 | 8/2014 | Scott | |

* cited by examiner

REVERSING CONFIGURATION CONTROL FOR STRING INSTRUMENTS

BACKGROUND OF THE INVENTION

This disclosure directs itself to a reversing configuration control for string instruments that permits switching between various combinations of a pair of electromagnetic pickup coils, either widely separated or collocated in a common enclosure, in one of series or parallel with the pickup coils being of like polarity, a single one of the pickup coils, and in one of series or parallel with the pickup coils being of opposite polarity, one with respect to the other. More in particular, the disclosure is directed to a reversing configuration control for string instruments that includes a pair of pickup coils disposed on a string instrument in which voltages are induced therein responsive to vibration of at least one string of the string instrument and a pair of potentiometers where at least one potentiometer is coupled to one of a pair of output terminals and one displaceable contact of at least one of the potentiometers is electrically connected to one of a pair of input terminals to which the pickup coils are connected. By that arrangement, selective operative coupling of the pair of pickup coils coupled in various configurations to the output terminals is provided. Still further, the disclosure is directed to a system wherein the selective operative coupling between the pair of pickup coils and the output terminals that is provided by the pair of potentiometers additionally selectively provides the effective coupling of only one of the pair of pickup coils to the output terminals. Further, the system can provide selective operative coupling of the pair of pickup coils in combination with the pickup coils having like polarity, selection of a single one of the pair of pickup coils, or can provide selective operative coupling of the pair of pickup coils in combination with one of the pickup coils having an opposite polarity with respect to the other pickup coil.

Electric string instruments, such as electric guitars, electric bases, electric violins, etc., use a pickup to convert the vibration of instrument's strings into electrical impulses. The most commonly used pickups uses the principle of direct electromagnetic induction. The signal generated by the pickup is of insufficient strength to directly drive an audio transducer, such as a loudspeaker, so it must be amplified prior to being input to the audio transducer.

Because of their natural inductive qualities, all magnetic pickups tend to pick up ambient electromagnetic interference (EMI) from electrical power wiring in the vicinity, such as the wiring in a building. The EMI from a 50 or 60 Hz power system can result in a noticeable "hum" in the amplified audio by from the audio transducer, particularly with poorly shielded single-coil pickups. Double-coil "Humbucker" pickups were invented as a way to overcoming the problem of unwanted ambient hum sounds. Humbucker pickups have two coils that are arranged with opposite magnetic poling and corresponding oppositely wound coils to produce a differential signal with respect to signals not generated as a result of the magnetic fields of the pickup. Since ambient electromagnetic noise effects both coils equally and since they are oppositely wound, the noise signals induced in the two coils are canceled out. The two coils of a Humbucker are often wired in series to give a fuller and stronger sound.

While most single coil pickups in multiple pickup installation are wired in parallel with each other, it is also possible to wire them in series, producing a fuller and stronger sound. The two coils of a Humbucker type pickup can also be connected in parallel. This results in a brighter sound, but at the cost of a lower output as with a single-coil pickup, but with the pickup's hum-cancelling properties of the Humbucker still being retained. Using a multiple pole, multiple throw switch, such as a double pole, double throw switch (DPDT) or double pole three position switch, it is known in the art to switch the coil configuration between series and parallel, and may also provide for a "coil cut" configuration (a single coil output).

By reversing the electrical polarity of one of two pickup coils connected in series or parallel, whether in a Humbucker pickup or a configuration of two single pickup coils, the concept of signal cancellation can be applied to the sound signals generated from the strings of the instrument. Signals from the two coils of the same frequency will be cancelled to some degree as a function of the phase and amplitude differences between them. As the string movement adjacent the bridge is less than adjacent the neck of the instrument, the bridge pickup will necessarily generate higher frequencies, including harmonics, than that generated by a neck pickup. To a lesser degree, the same is true for the coils of a Humbucker pickup. The coil of a Humbucker pickup closest to the bridge of the instrument will generate higher frequencies than the coil which is further from the bridge. Musicians have employed this concept to change the sound of their instrument to create particular effects. The reversing of the polarity of one coil relative to the other substantially removes the lower fundamental frequencies in the output signal from the combined pickup coils, leaving the higher frequencies and harmonics. To that end, coil reversing switches have been added to prior art systems.

Blend potentiometers, usually formed by two potentiometers ganged together to be rotated by a single shaft, allow blending together outputs of two pickup coils in varying degrees, not unlike a balance control provided in stereo equipment. Blend potentiometers, however, do not accomplish switching of the coil configuration or coil reversing. In one known prior art system disclosed in U.S. Pat. No. 4,423,654, a tone control formed with a pair of ganged rheostats is connected to the two coils of a Humbucker type pickup. The operation of this tone control provides a series coil configuration at one end of the rotation of the control and a parallel configuration at the opposing end of the rotation thereof. Of the two rheostats used, the resistance element of one is configured to have substantially zero resistance (zero ohms) between one end terminal and the midpoint of the resistance element's length and thereafter increase linearly, while the other rheostat has a resistance that increases logarithmically along its length. Due to the logarithmic taper of the resistance element, from the one end of the travel of the control that provides a series configuration of the coils to and including the midpoint thereof, the series configuration is maintained, changing only the high frequency attenuation included in the control.

SUMMARY OF THE INVENTION

A reversing configuration control for string instruments having at least a pair of pickup coils is provided that includes a pair of output terminals, and a respective pair of input terminals coupled to each of the pair of pickup coils. The reversing configuration control further includes a pair of potentiometers each having a displaceable contact. The pair of potentiometers are mechanically coupled for concurrent mechanical travel of their respective displaceable contacts. At least one of the pair of potentiometers is coupled to one of the pair of output terminals and at least one of the displaceable contacts is coupled to one of the input terminals. The pair of potentiometers provides selective operative coupling of the pair of pickup coils to the output terminals responsive to a position of the displaceable contacts with respect to the mechanical travel thereof. By that arrangement, the selective operative coupling includes (a) the pair of pickup coils being coupled with like polarity in one of series or parallel to the output terminals, or (b) effectively coupling only one of the pair of pickup coils to the output terminals, or (c) the pair of pickup coils being coupled with opposing polarity in one of series or parallel to the output terminals.

From another aspect, a reversing configuration control for string instruments is provided that includes a pair of pickup coils and a pair of output terminals. The reversing configuration control further includes a respective pair of input terminals coupled to each of the pair of pickup coils. Further the reversing configuration control includes a pair of potentiometers each having a displaceable contact. The pair of potentiometers are mechanically coupled for concurrent mechanical travel of their respective displaceable contacts. At least one of the pair of potentiometers is coupled to one of the pair of output terminals and at least one of the displaceable contacts is coupled to one of the input terminals. The pair of potentiometers provide selective operative coupling of the pair of pickup coils to the output terminals responsive to a position of the displaceable contacts with respect to the mechanical travel thereof. By that arrangement, the selective operative coupling includes (a) the pair of pickup coils being coupled with like polarity in one of series or parallel to the output terminals, or (b) effectively coupling only one of the pair of pickup coils to the output terminals, or (c) the pair of pickup coils being coupled with opposing polarity in one of series or parallel to the output terminals.

DETAILED DESCRIPTION OF THE PREFERRED EMBODIMENTS

Figure 1A:
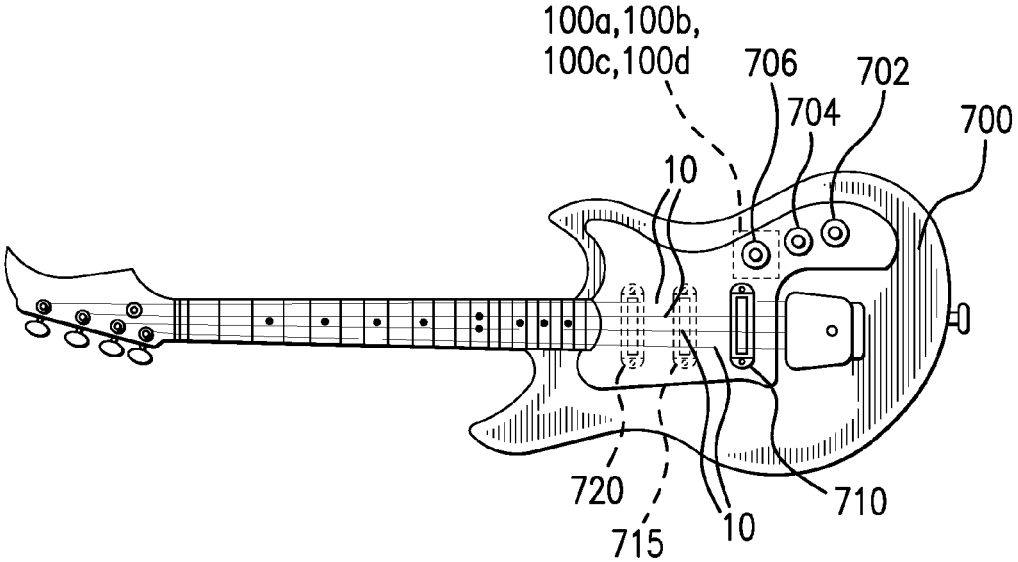
FIG. 1A is an illustration of an electric string instrument incorporating the reversing configuration control of the present invention and showing typical locations of pickup transducers for sensing string vibrations.

Referring to FIGS. 1A-5C, there is shown reversing configuration control 100*a*, 100*b*, 100*c*, 100*d* for use with an electric string instrument. Reversing configuration control 100*a*, 100*b*, 100*c*, 100*d* provides selective variation the electrical configuration of a pair of pickup coils 150 and 160 between being connected with their polarity being in common in one of series or parallel, effectively providing the output of a single one of the pickup coils, and being connected with the polarity of one pickup coil having an opposite polarity respect to the other while being in one of series or parallel, without the need for electrical switches to change the configuration.

As used herein the terms "like polarity," "common polarity," "polarity in common," "same polarity" and the like all refer to the pickup coil property known as phase where the two pickup coils have the same phase. The phase property of a pickup coil is a designation of the direction that current flows through that coil and usually indicated by plus (+) symbol representing outgoing current (positive terminal), and minus (−) symbol representing incoming current (negative terminal). The terms "opposite polarity," opposing polarity," "reverse polarity" and the like refer to the two pickup coils having an opposite phase, i.e. having current flows that are 180 degrees out of phase with each other.

When pickup coils of like or common polarity are coupled in series, the plus designated terminal (outgoing current) of one pickup coil is connected to the minus designated terminal (incoming current) of the other pickup coil. In the case where pickup coils of opposite polarity are coupled in series, the plus designated terminal of one pickup coil is connected to the plus designated terminal of the other pickup coil, or the minus designated terminal of one pickup coil is connected to the minus designated terminal of the other pickup coil. When pickup coils of like or common polarity are coupled in parallel, the plus designated terminals of the two pickup coils are connected together and the minus designated terminals of the two pickup coils are also connected together. Whereas, when pickup coils of opposite polarity are coupled in parallel, the plus designated terminal of a first of the pickup coils is connected to the minus designated terminals of the second pickup coil and the plus designated terminal of that second pickup coil is connected to the minus designated terminal of the first pickup coil.

In the series mode, with pickup coils of like polarity, the output will be strong with a smooth attack and a deep tone, in the single coil mode the output will be classic single tone, and in the parallel mode, with pickup coils of like polarity, the sound will be very clean and sparkly. When one of the pickup coils is connected with a reverse polarity relative to the other pickup coil, the series and parallel effects are modified by the cancellation of the lower fundamental frequencies of the sound signals and often used in performances of both rock and country music.

As is known in the art, one or more magnetic pickup coils are positioned in correspondence with the strings of the instrument so that they are able to produce an electrical signal in response to vibration of at least one of the multiple strings of the instrument. Humbucker type pickups are commonly used with electric string instruments because they provide for cancellation of electromagnetic interference (EMI), such as the 50 or 60 Hz "hum" that is induced from nearby electrical power wiring. As shown in FIG. 1B, the Humbucker type pickup 710 has two pickup coils 150 and 160 in a single enclosure that are poled (magnetic field direction) and phased (electrical polarity) to provide cancellation of common mode noise signals.

Figure 1B:
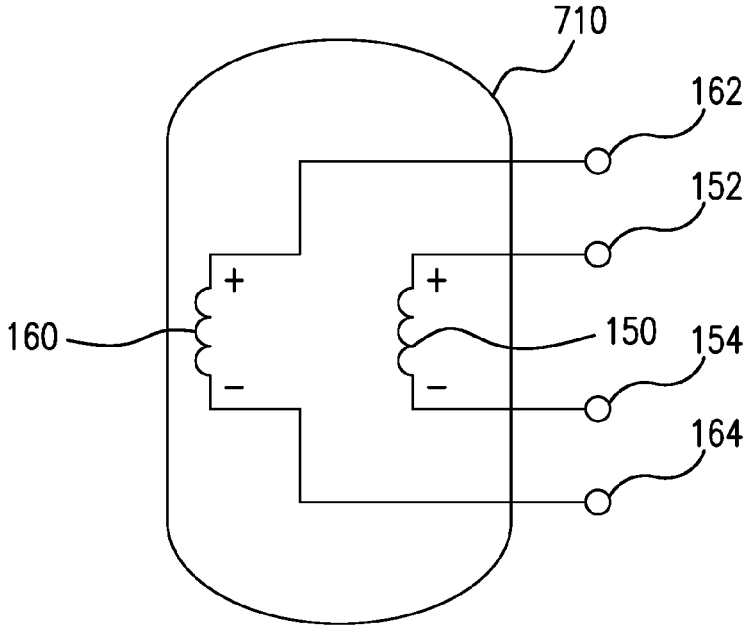
FIG. 1B is a schematic illustration of a Humbucker type pickup sensor for string instruments useable in the present invention.

Shown in FIG. 1A, is an exemplary electric string musical instrument 700 in the form of a guitar that incorporates reversing configuration control 100*a*, 100*b*, 100*c*, 100*d*. As is typical of such musical instruments, guitar 700 includes a plurality of strings 10, the vibrations of which are sensed by at least the pickup sensor 710, which may be a Humbucker type pickup device. Using the reversing configuration control 100*a*, 100*b*, 100*c* or 100*d*, the two coils 150 and 160 of a Humbucker type pickup 710, the coils 150 and 160 can be selectively connected in different configurations. Although only a single pickup sensor is necessary for the guitar to function as a musical instrument, a broad range and variation of sounds can be generated using multiple pickup sensors. The pickup sensor 710 is located on the guitar 700 in proximity to the bridge of the instrument and as an alternative to a Humbucker type pickup sensor, the pickup 710 may be a single coil sensor and another sensor 715 or 720 located on the guitar 700 for connection to the reversing configuration control 100*a*, 100*b*, 100*c* or 100*d*, in wherein the pickup sensor 710 includes the pickup coil 160 and the other sensor 715 or 720 includes the pickup coil 150. The bridge being an anchor point for the strings, limits the displacement of the strings adjacent thereto. As a result, higher frequency components of the sound are transduced by the pickup sensor 710. The optional pickup sensor 720, on the other hand, is located in proximity to the neck of the guitar 700. Since the neck region is a relatively substantial distance from the anchor points of the strings, the strings are able to vibrate with greater amplitude (move a greater distance) and thereby produce lower frequency components of the sound. The optional pickup sensor 715 is located between the neck and bridge, where the strings have greater movement compared to the bridge, but less movement than the region adjacent the neck and therefore produce frequency components intermediate the bridge and neck sensor locations. Thus, reversing configuration control 100*a*, 100*b*, 100*c* or 100*d* can be connected to single coil sensors 710 and 715 or 710 and 720, as examples. Although reversing configuration control 100*a*, 100*b*, 100*c* or 100*d* may be utilized to configure the sensors 715 and 720, and in fact any two pickup coils, it is believed that a combination with a sensor adjacent the bridge provides a better sounding combination for use in the reverse polarity coil configurations, where common frequency component generated by the sensors are cancelled to some degree as a function of their phase and amplitude differences.

FIG. 1B schematically illustrates the arrangement of a Humbucker type pickup sensor 710 which may be used in place of the exemplary combinations of separate single coil pickup sensors 710 and 720 or 710 and 715 of the guitar 700. The Humbucker type pickup sensor 710 includes a pair of coils 160 and 150. Coil 160 has a pair of terminals 162 and 164 connected to opposing ends thereof. Similarly, coil 150, 720*b* has a pair of terminals 152 and 154 connected to its opposing ends. As is known in the art, Humbucker pickups are arranged to be of opposite magnetic and electric polarity so as to produce a differential signal. Since ambient electromagnetic noise affects both coils equally and since the coils are wound oppositely, the noise signals induced in the two coils cancel each other out. The two coils of a Humbucker are often wired in series to give a fuller and stronger sound. The two coils of a Humbucker type pickup can also be connected in parallel, which results in a brighter sound, albeit with a weaker output, but with the pickup's hum-cancelling properties still being retained. Obviously, when the output of the pickup is from only a single one of the two coils, there will be no hum cancellation but, also there will be no filtering effect as occurs when the two coils are connected in series. No hum-cancelling effect results then the electrical polarity of one coil is reversed either, but the cancellation effect of the fundamental frequencies of the string vibrations is a much greater and desirable effect that is achieved by this configuration.

As a result of these differences in the sound effects generated by the different connection schemes of the two coils of the Humbucker type pickup sensor 710 or in the alternative where multiple single coil sensors are utilized, different connection schemes of pickup sensors 710 and 720 or 710 and 715, the musician playing guitar 700 will use reversing configuration control 100*a*, 100*b*, 100*c* or 100*d* to select, blend or configure the signals output from the pickup sensor coils. Guitar 700 is provided with rotatable control knobs 702, 704 and 706. Control knob 702 is connected to a tone control (not shown in the figures), allowing the musician to vary the sounds from the guitar 700 by changing the filtering applied to the electrical signals before they are coupled to the amplifier 300. Control knob 704 is connected to the shaft of the volume control potentiometer 200, allowing the musician to vary the volume while playing the instrument. Control knob 706 is connected to the mechanically coupled potentiometers 130 and 140, 130 and 140', or 130' and 140' of reversing configuration control 100*a*, 100*b*, 100*c* or 100*d* to provide selection, blending and/or configuration changing of the pickup coils. It should be understood that where multiple Humbucker type pickup sensors are utilized on a string instrument a separate reversing configuration control 100*a*, 100*b*, 100*c* or 100*d* can be connected to the coils of a corresponding one of Humbucker type pickup sensors.

Figure 1C:
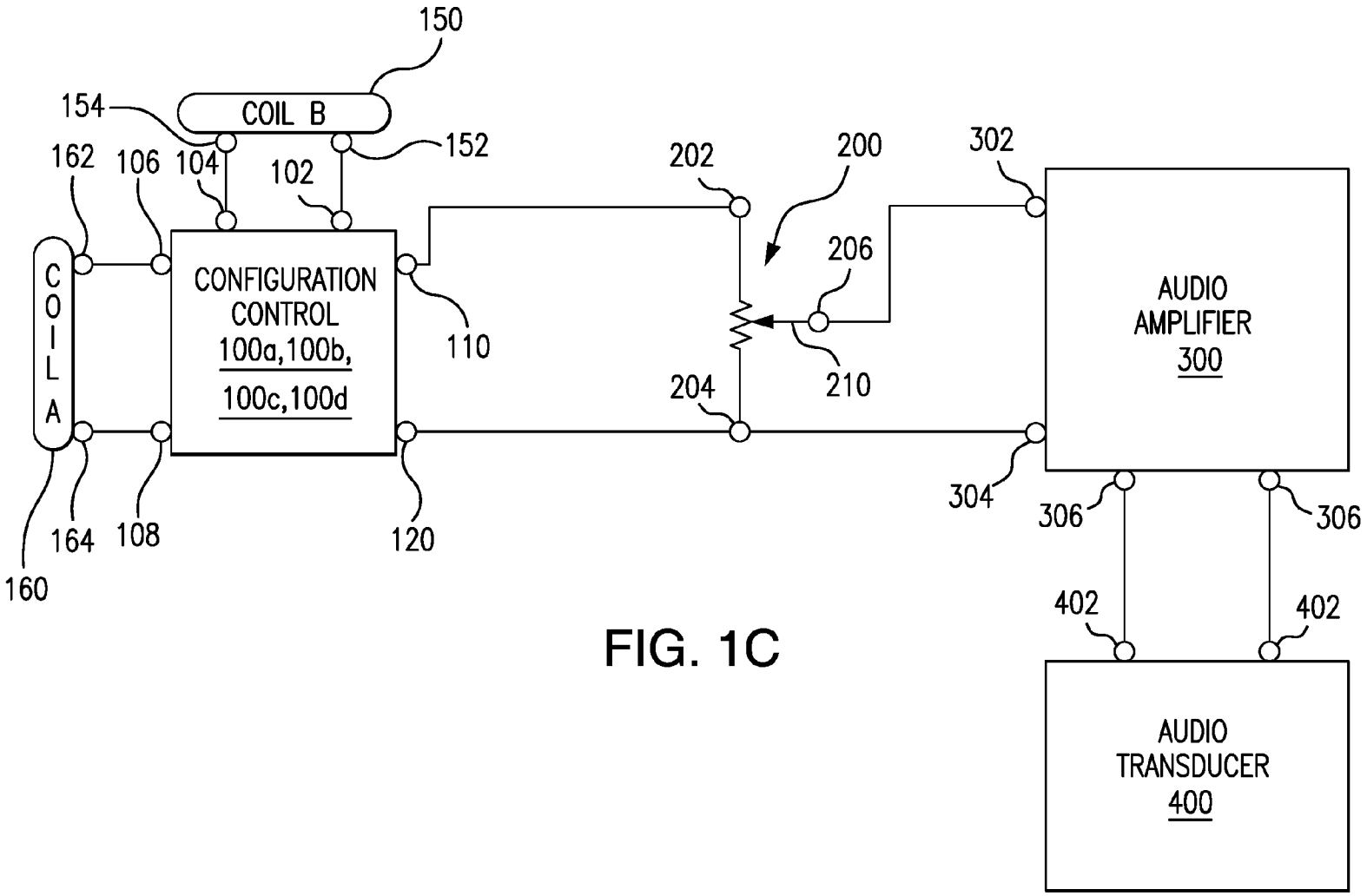
FIG. 1C is a block diagram illustrating the basic audio system for an electric string instrument incorporating the reversing configuration control of the present invention.

Turning now specifically to FIG. 1C, there is shown a block diagram of the basic audio system for an electric string instrument that incorporates the novel reversing configuration control 100*a*, 100*b*, 100*c* or 100*d* disclosed herein. The electromagnetic sensing coils 160 (coil A) and 150 (coil B) generate voltage signals responsive to the vibrational movement of the strings of a stringed instrument, such as guitars, violins, cellos, harps, banjos, mandolins, bases, etc. and the reversing configuration control 100*a*, 100*b*, 100*c* or 100*d* configures how the generated voltages are combined or selects the output of coil A 160 alone. Coil A 160 has a pair of output terminals 162 and 164 that are respectively connected to input terminals 106 and 108 of reversing configuration control 100*a*, 100*b*, 100*c*, 100*d*, and coil B 150 has a pair of output terminals 152 and 154 that are respectively connected to input terminals 102 and 104 of reversing configuration control 100*a*, 100*b*, 100*c*, 100*d*.

The generated signals, as configured or selected are output to terminals 110 and 120, which are respectively connected to terminals 202 and 204 of volume control 200. Volume control 200 is a potentiometer that functions as a voltage divider with its displaceable contact connected to an output terminal 206. The signal level at output terminal 206 relative to terminal 204 will be in relation to the resistance between those terminals with respect to the total resistance between terminals 202 and 204. The output of volume control 200 provided from terminals 206 and 204 are respectively coupled to terminals 302 and 304 of an audio amplifier 300. Although not illustrated in FIG. 1C, it is common to add various additional tone controls between the output of volume control 200 and the input of audio amplifier 300, in the form of resistance-capacitance (RC) filters where the resistance element is a potentiometer.

The output signal level of Humbucker type pickup sensor may be on the order of 100-500 mV, which can then be reduced by adjustment of volume control 200. Audio amplifier 300 increases the signal level, voltage and current, sufficiently to drive an audio transducer 400, such as headphones or one or more speakers. The output terminals 306 of audio amplifier 300 are connected to the input terminals 402 of audio transducer 400. Although, audio amplifier 300 is shown with a single pair of output terminals, it should be understood that multiple separate outputs may be provided to simultaneously drive a plurality of audio transducers 400.

Figure 2A:
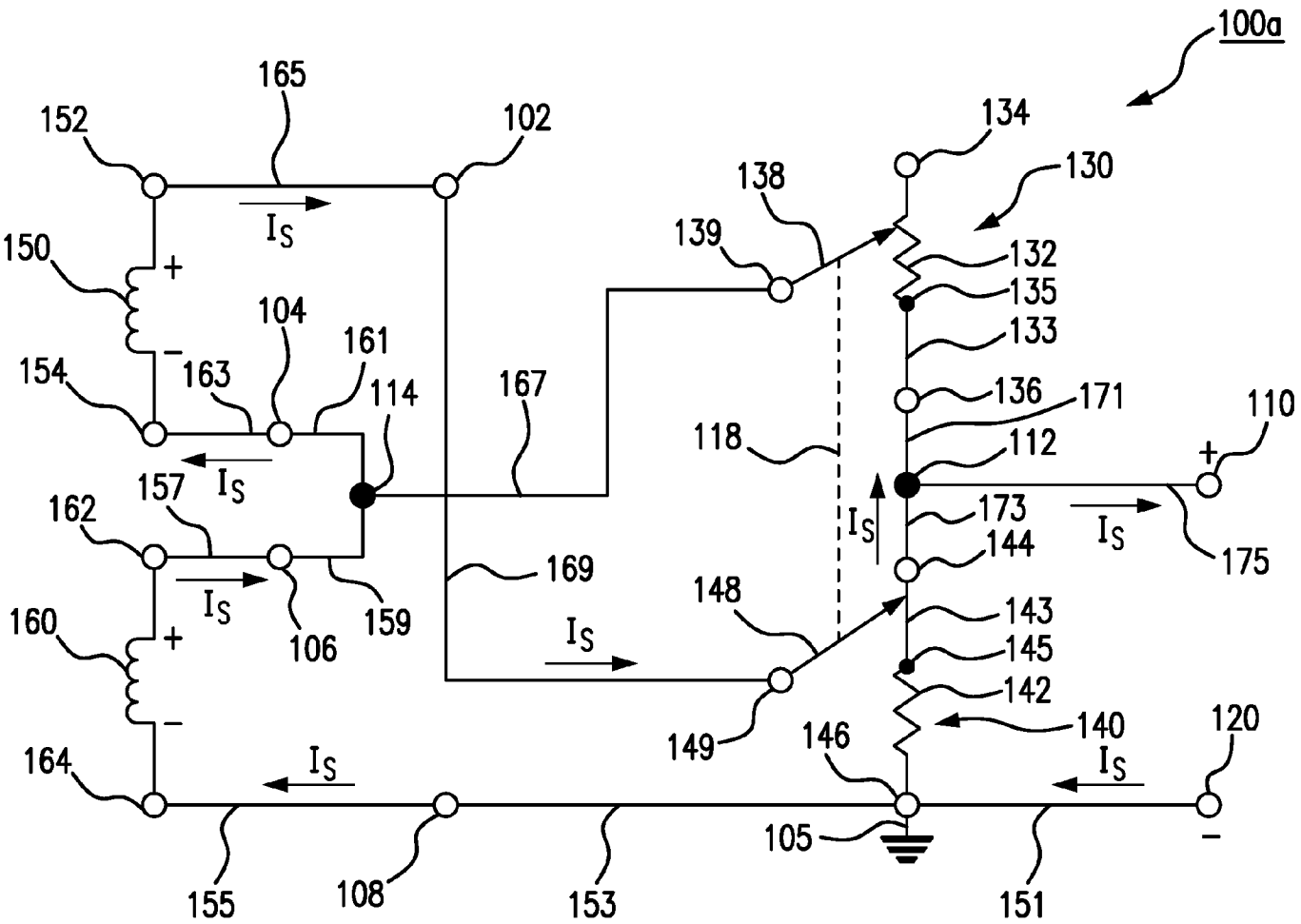
FIG. 2A is a schematic electrical diagram of the reversing configuration control of the present invention adjusted for a series configuration of pickups of common polarity.
Figure 2B:
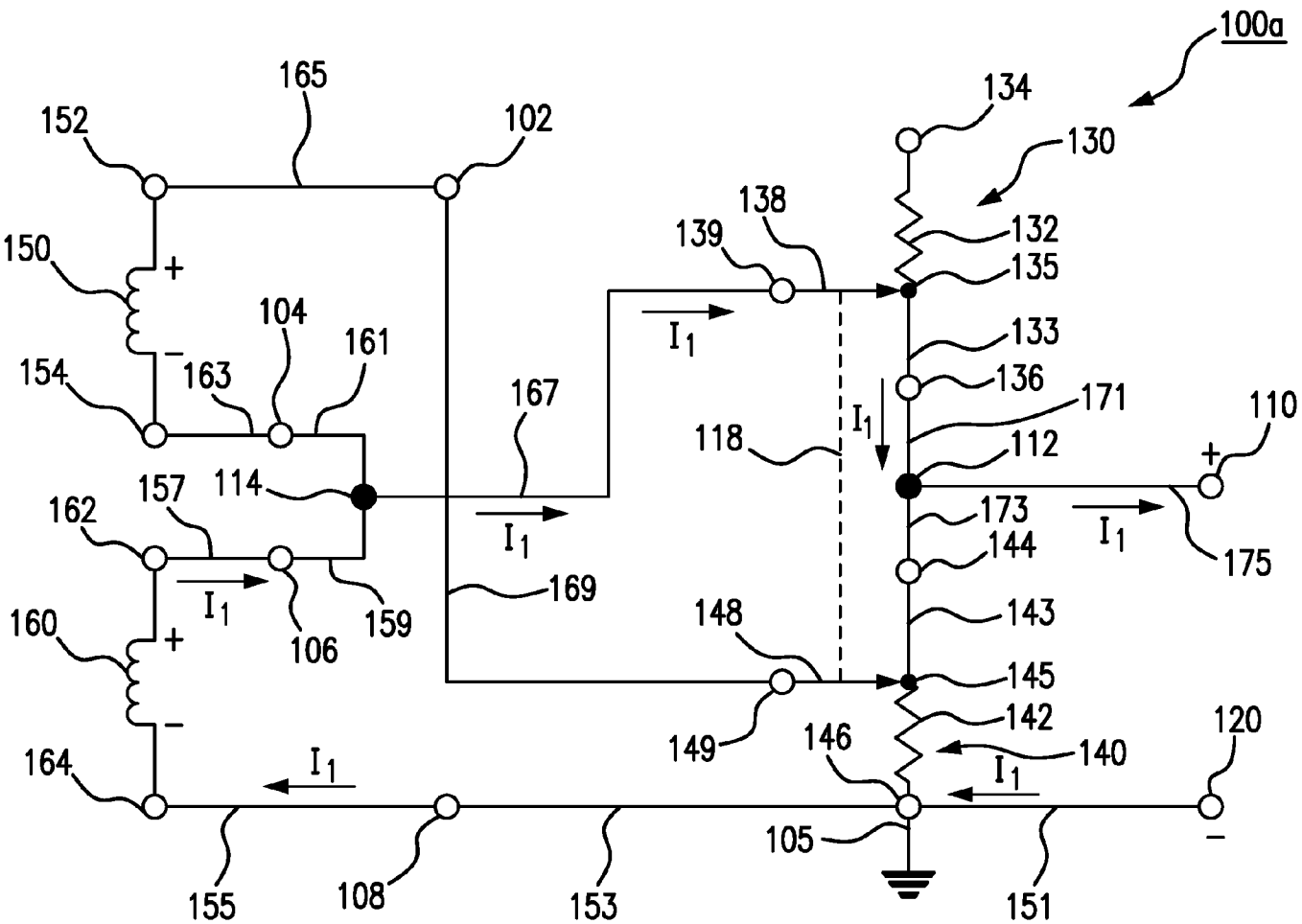
FIG. 2B is a schematic electrical diagram of the reversing configuration control adjusted for a single coil configuration.
Figure 2C:
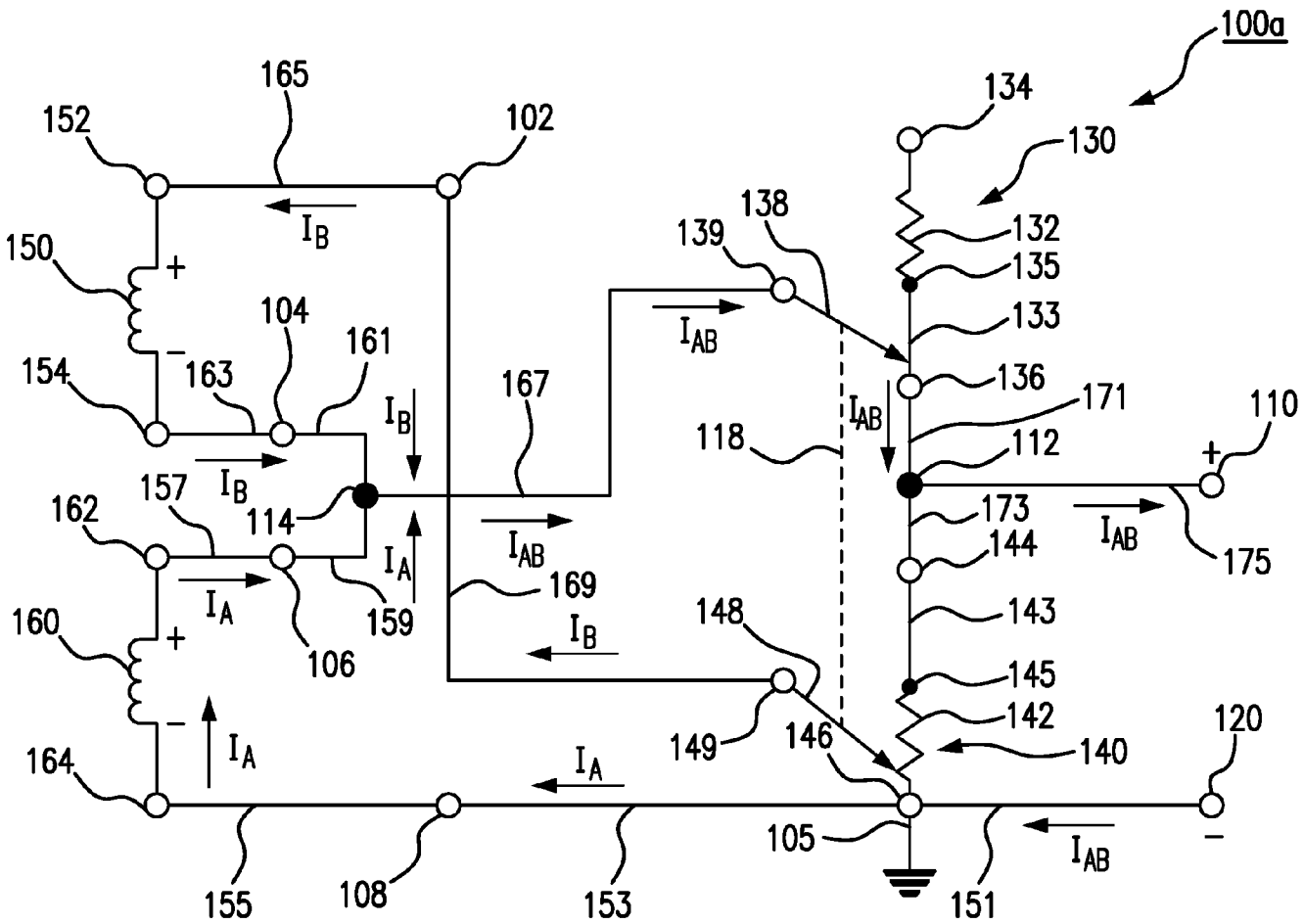
FIG. 2C is a schematic electrical diagram of the reversing configuration control adjusted for a parallel configuration of pickups of opposite polarity.

Referring now to FIGS. 2A, 2B and 2C, there are shown schematic diagrams of reversing configuration control 100*a* at different respective setting to demonstrate the changes in pickup coil configuration that are obtained therewith. Reversing configuration control 100*a* includes a pair of potentiometers 130 and 140 that provide the mechanism for changing the configuration of the pair of pickup coils 150 and 160 between being coupled in series with like polarities (in phase) at one end of the travel of potentiometers 130 and 140 and being coupled in parallel with opposing polarities (out of phase) at the opposing end of the travel thereof. At an intermediate point of the travel of potentiometers 130 and 140, the output of a single pickup coil 160 is coupled to the output terminals 110 and 120. Potentiometers 130 and 140 each include a resistive element connected between a pair of terminals 134, 136 and 144, 146 and a corresponding displaceable contact 138, 148 respectively coupled to an output terminal 139, 149. Potentiometers 130 and 140 are mechanically coupled together, as represented by the coupling line 118, and may be rotary or linear movement types with their resistive elements being in the approximate range of 125 KΩ to 500 KΩ. In one working embodiment, potentiometers 130 and 140 were implemented as rotary type dual-gang potentiometers, which are two potentiometers combined on a common shaft, available from Bourns, Inc. of Riverside, Calif. and having the designation PDB182-GTRB with resistive element portions 132 and 142 being 250 KΩ.

Potentiometer 130 has a resistance at 0% output with respect to terminal 136 over the initial 50% of mechanical travel of the displaceable contact 138 from the end connected to terminal 136 defined by the resistive element portion 133, and increases linearly (linear taper) from 0% to 100% over the remaining 50% of the travel, defined by the element portion 132. While potentiometer 140 is constructed oppositely, with the resistance with respect to terminal 146 decreasing linearly (linear taper) from 100% to 0% over the initial 50% of mechanical travel of the displaceable contact 148 from the end connected to terminal 146 defined by the element portion 142, and remains at 0% over the remaining 50% of the travel, defined by the element portion 143. In some applications the musician who owns the string instrument incorporating tone blend configuration control 100*a* may prefer a nonlinear resistive taper, such as logarithmic taper which is also known as an audio taper, for either or both of potentiometers 130 and 140. Regardless of the taper, reversing configuration control 100*a* will function as described herein with respect to the pickup coil configurations at the endpoints of mechanical travel of the displaceable contacts 138, 148 and at an intermediate point of the mechanical travel, which is typically the midpoint.

Pickup coils 150 and 160 may be two separately mounted individual coils located on the instrument, each in proximity to the strings 10 at different locations along their extent. Single coil pickups having the designation SSL-1 and SSL-5 available from the Seymour Duncan Company of Goleta, Calif. have been successfully used with reversing configuration control 100*a*, 100*b*, 100*c*, 100*d*. As previously discussed, two collocated coils that are provided in a single package are also usable with reversing configuration control 100*a*, 100*b*, 100*c*, 100*d*. In one working embodiment, pickup coils 150 and 160 were implemented with a humbucking series EMG-HZ type pickup available from EMG, Inc. of Santa Rosa, Calif. Both types of pickup sensor, single coil and Humbucker type, are well known and widely available.

The following connections apply to each of FIGS. 2A, 2B, 2C, 3A, 3B and 3C. Output terminal 120 is connected by conductor 151 to terminal 146 of the potentiometer 140, which is connected to a ground reference 105. All of the conductors of reversing configuration control 100*a*, 100*b*, 100*c*, 100*d* may formed by conductive wires, conductive tracks on a printed circuit board, or a combination thereof. Terminal 146 is further connected to input terminal 108 by conductor 153 and input terminal 108 is connected by conductor 155 to negative output terminal 164 of pickup coil 160. The opposing positive output terminal 162 of pickup coil 160 is coupled to input terminal 106 by conductor 157. Input terminal 106 is connected to a node 114 by conductor 159, as is the input terminal 104 via the corresponding conductor 161. Node 114 is connected to the displaceable contact terminal 139 of potentiometer 130 by the conductor 167.

Input terminal 104 is connected to the negative output terminal 154 of pickup coil 150 by the conductor 163 and the opposing positive output terminal 152 of pickup coil 150 is coupled to input terminal 102 by conductor 165. Input terminal 102 is connected to the displaceable contact terminal 149 of potentiometer 140 by the conductor 169. The terminal 134 of potentiometer 130 is open circuited (unconnected) and the opposing terminal 136 is connected to the node 112 by the conductor 171. Similarly, the terminal 144 of potentiometer 140 is connected to the node 112 by the conductor 173 and node 112 is coupled to output terminal 110 by the conductor 175. Reference numerals presented in FIGS. 2A, 2B and 2C that are in common with those in FIG. 1 represent the same elements.

The functioning of reversing configuration control 100*a* will now be described, beginning with the displaceable contacts 138, 148 being at a first end of their respective mechanical travel, as shown in FIG. 2A. At the first end of mechanical travel, the resistance between the terminals 136 and 139 of displaceable contact 138 is 100%. of the resistance of the corresponding resistive element portion 132, and the resistance between terminals 144 and 149 of displaceable contact 148 is zero ohms. The resistance between the terminals 146 and 149 of displaceable contact 148 is 100%. of the resistance of the corresponding resistive element portion 142. Although the pickup coils 110 and 120 generate the current that flows to and from output terminals 110 and 120 responsive to vibrational movement of the strings 10 of the instrument 700 incorporating reversing configuration control 100*a*, for simplicity we will start by following a current $I_S$ flowing into the negative output terminal 120. The current $I_S$ flows to input terminal 108 and pickup coil 160 negative output terminal 164 through the conductors 151, 153 and 155 and intervening terminals 146 and 108. While the conductor 151 connects output terminal 120 to the terminal 146 of potentiometer 140, as a result of the high resistance, 100%, between terminal 146 and either of terminals 144 or 149 (due to the position of displaceable contact 148) the current that flows through those paths is negligible and thus, for practical purposes no current flows therethrough.

From terminal 164, the current $I_S$ flows from the negative terminal 164 of pickup coil 160, through the pickup coil 160 to the positive output terminal 162 thereof and through the conductor 157 to input terminal 106. The current Is flows from input terminal 106 to the terminal 104 via the conductor 159, the node 114 and the conductor 161. The node 114 is connected to the displaceable contact terminal 139 of potentiometer 130, but due to the high resistance, 100%, between terminal 139 and terminal 136 (as a result of the position of displaceable contact 138) the current that flows through that path is negligible. Thus again, for practical purposes, no current therefore flows through potentiometer of 130. The current $I_S$ flows through the pickup coil 150 to the positive output terminal 152 and through conductor 165 to input terminal 102. From input terminal 102, the current Is flows through the conductor 169 to the displaceable contact terminal 149 of potentiometer 140 and through the displaceable contact 148 to terminal 144. From terminal 144 of potentiometer 140, the current $I_S$ flows to output terminal 110 through conductor 173, node 112 and conductor 175, thereby completing the current path through reversing configuration control 100*a*. The high resistance between the terminals 136 and 139 of potentiometer 130 prevent current flow through conductor 171. Clearly, as the same current, $I_S$, flows through both pickup coils 160 and 150, with the positive terminal of coil 160 connected to the negative terminal of coil 150, the pickup coils are coupled in series with like polarity. For series coupled pickup coils, the voltages generated in the coils is additive, but provide a higher impedance to higher frequency audio signals, providing a filtering effect, and hence they are said to provide a fuller and stronger sound.

As shown in FIG. 2B, the potentiometers 130, 140 are set at an intermediate point of their mechanical travel 135, 145, which is typically the midpoint thereof and may incorporate a mechanical detent at that position to provide a tactile indication of that position to the musician. With the displaceable contacts 138 and 148 at that position, there is zero ohms resistance between terminals 139 and 136 of potentiometer 130 and for potentiometer 140 there is zero ohms resistance between terminals 149, and 144 and 100% of the resistance between terminals 149 and 146 as a result of the resistance element 142.

A current $I_1$ flows into the negative output terminal 120 to input terminal 108 and pickup coil 160 negative output terminal 164 through the conductors 151, 153 and 155 and intervening terminals 146 and 108. Here again, the conductor 151 connects output terminal 120 to the terminal 146 of potentiometer 140, but due to the high resistance of the resistive element portion 142, no current flows therethrough. From terminal 164, the current $I_1$ flows from the negative terminal 164 of pickup coil 160, through the pickup coil 160 to the positive output terminal 162 thereof and through the conductor 157 to input terminal 106. The current $I_1$ flows from input terminal 106 to node 114 to the displaceable contact terminal 139 of potentiometer 130, via conductors 159 and 167, and through the zero ohm portion 133 of the potentiometer's resistive element to the terminal 136. From terminal 136, the current $I_1$ flows to output terminal 110 through conductor 171, node 112 and conductor 175. You will note that the negative terminal 154 of pickup coil 154 is likewise coupled to node 112 through potentiometer 130 by virtue of its connection to node 114 via conductor 163, input terminal 104 and conductor 161. The opposing positive terminal 152 of pickup coil 150 is also connected to the node 112 by conductor 165, input terminal 102, conductor 169, and the potentiometer 140, via displaceable contact terminal 149, displaceable contact 148, the zero ohm resistive element portion 143, terminal 143 and conductor 173. Since both the positive and negative output terminals of pickup coil 150 are coupled to node 112, the output of pickup coil 150 is shunted (short circuited) from the output terminals 110 and 120 and does not contribute to the output signal of reversing configuration control 100*a*. Therefore, at the intermediate position of the of the travel of potentiometers 130 and 140, only the output signals from the pickup coil 160 are output at terminals 110 and 120 to provide the conventional single coil full frequency spectrum sound.

Considering displaceable contact settings intermediate the end of the displaceable contact travel shown in FIG. 2A and the position shown in FIG. 2B there is a blending of the outputs of the pickup coils 150 and 160. As the displaceable contacts 138, 148 are positioned further from the intermediate position 135, 145 toward the end of the mechanical travel shown in FIG. 2A, a greater percentage of the output of the pickup coil 150 is added in series with like polarity with that of pickup coil 160. This provides a gradual transition between the two distinct configurations and provides a greater range of sound effect variations than provided by pickup coil selection switches.

Turning now to FIG. 2C, the potentiometers 130, 140 are set with the displaceable contacts 138, 148 positioned at the opposing second end of their respective mechanical travel compared with that of FIG. 2A. At the second end of the mechanical travel of displaceable contacts 138, 148, the resistance between the terminals 136 and 139, as well as between terminals 146 and 149 is zero ohms. By virtue of the displaceable contacts 138 and 148 being at the second end of the mechanical travel, the resistance between the terminals 134 and 139, as well as between terminals 144 and 149 of displaceable contacts 138, 148 is 100%. of the resistance of the corresponding resistive element portion 132, 142.

Starting again at negative output terminal 120, the current $I_{AB}$ flows to terminal 146 of potentiometer 140 where it divides into a current $I_A$ flowing to input terminal 108 via conductor 153 and a current $I_B$ flowing to terminal 149 of potentiometer 140 through the displaceable contact 148. From input terminal 108, the current $I_A$ flows through the pickup coil 160 via conductor 155 and negative pickup coil terminal 164 to the input terminal 106 by way of positive pickup coil terminal 162 and conductor 157. The current $I_B$ flows from terminal 149 to the positive pickup coil terminal 152 through conductor 169, input terminal 102 and conductor 152. From there, the current $I_B$ flows through the pickup coil 150 to the negative pickup coil terminal 154 and therefrom to input terminal 104 through conductor 163. The current $I_A$ flows from input terminal 106 to the node 114 through conductor 159 to be combined with the current $I_B$ flowing from input terminal 104 through conductor 161 to node 114.

The combined current $I_{AB}$ flows from node 114 to potentiometer terminal 136 via conductor 167, terminal 139 and displaceable contact 138 of potentiometer 130. From terminal 136, the current $I_{AB}$ flows to output terminal 110 through the conductor 171, node 112 and conductor 175. No current flows from node 112 through the potentiometer 140 due to the high resistance between terminals 144 and 146 thereof. Hence, the potentiometer setting in this example provides two parallel branches with a respective one of the two pickup coils being in each branch. However, it can be seen that the negative terminal of pickup coil 150 and the positive terminal of the pickup coil 160 are coupled in common to the positive output terminal 110 and the negative terminal of the pickup coil 160 and the positive terminal of pickup coil 150 are coupled in common to the negative output terminal 120. Thus the polarity of one pickup coil with respect to the other is reversed, which results in subtraction of signals generated by the two coils as a function of their respective amplitudes and phase differences, producing a difference signal at the output of reversing configuration control 100*a*. Accordingly, signals of equal amplitude and of like frequency and phase will be cancelled out. As the distance between the two pickup coils on the instrument will determine the phase difference in the signals generated by the two pickup coils and range of signal frequencies generated will be determined by their locations on the instrument, greater cancellation of signals will be obtained when using two coils of a Humbucker type pickup than when using a single bridge pickup coil and a single neck pickup coil, for example.

Now considering displaceable contact settings intermediate the end of the displaceable contact travel shown in FIG. 2C and the position shown in FIG. 2B there is a blending of the outputs of the pickup coils 150 and 160, with the effect of pickup coil 150 being gradually diminished as the displaceable contact is moved toward the position shown in FIG. 2B.. Accordingly, as the amplitude of the signals generated by pickup coil 150 are reduced, so too is the signal cancellation effect. This provides a gradual transition between the two distinct configurations and again provides a greater range of sound effect variations than provided by pickup coil selection switches.

The polarity of either of pickup coils 150 or 160 can be reversed in their connection to reversing configuration control 100*a*. Thus, the positive terminal 152 of pickup coil 150 can be connected to input terminal 104 and the negative terminal 154 thereof correspondingly connected to input terminal 102. Alternately, the positive terminal 162 of pickup coil 160 can be connected to input terminal 108 and the negative terminal 164 thereof correspondingly connected to input terminal 106. With this alternative connection scheme for one of the pickup coils, reversing configuration control 100*a* provides the pickup coils 150 and 160 in a series configuration with opposing polarity at the first end of the mechanical travel of displaceable contacts 138, 148; only the pickup coil 160 output at the intermediate position of the mechanical travel of displaceable contacts 138, 148; and provides the pickup coils 150 and 160 in a parallel configuration with like polarity at the second end of the mechanical travel of displaceable contacts 138, 148.

Figure 3A:
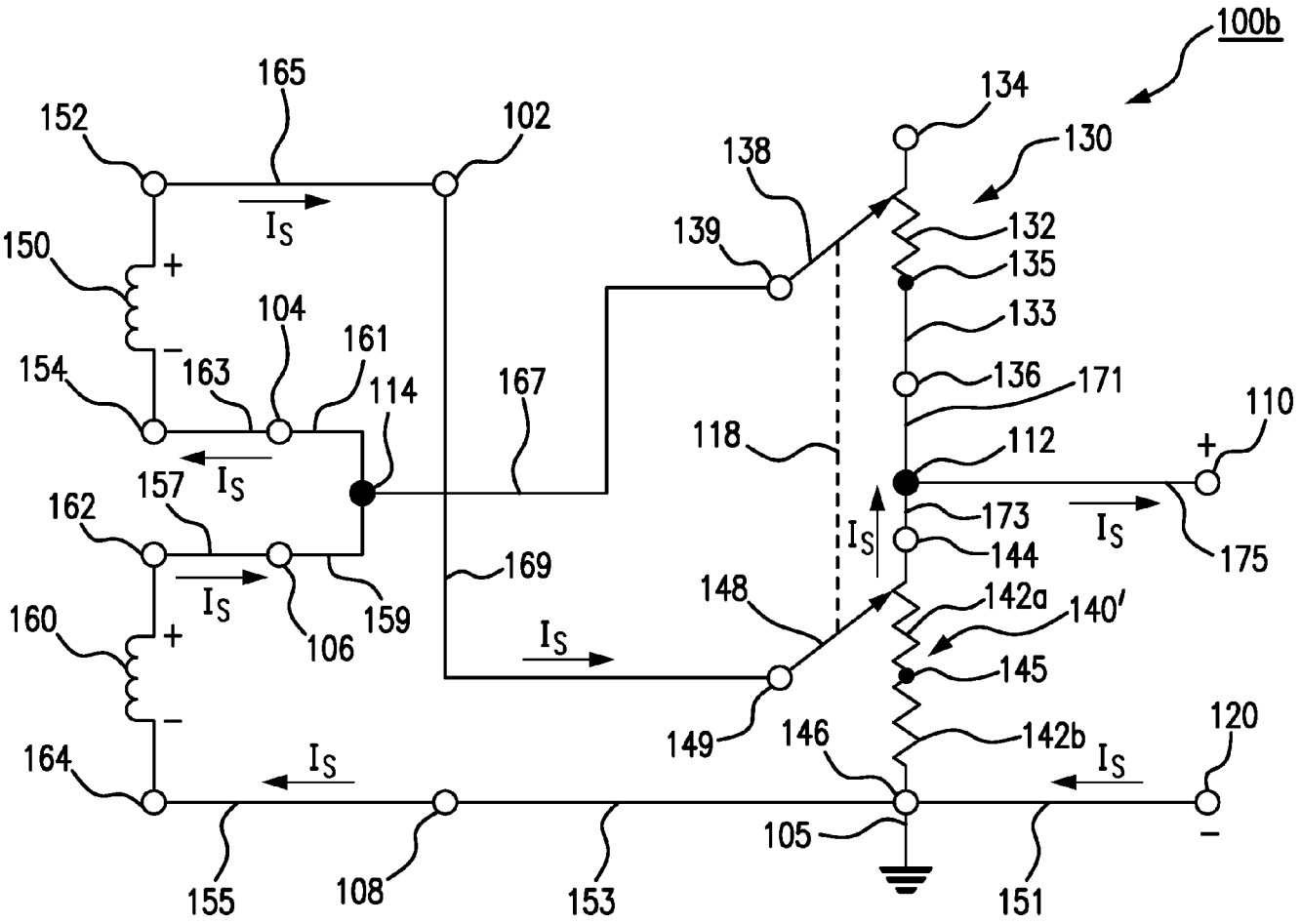
FIG. 3A is a schematic electrical diagram of the reversing configuration control of the present invention with an alternate potentiometer arrangement adjusted for a series configuration of pickups of common polarity.
Figure 3B:
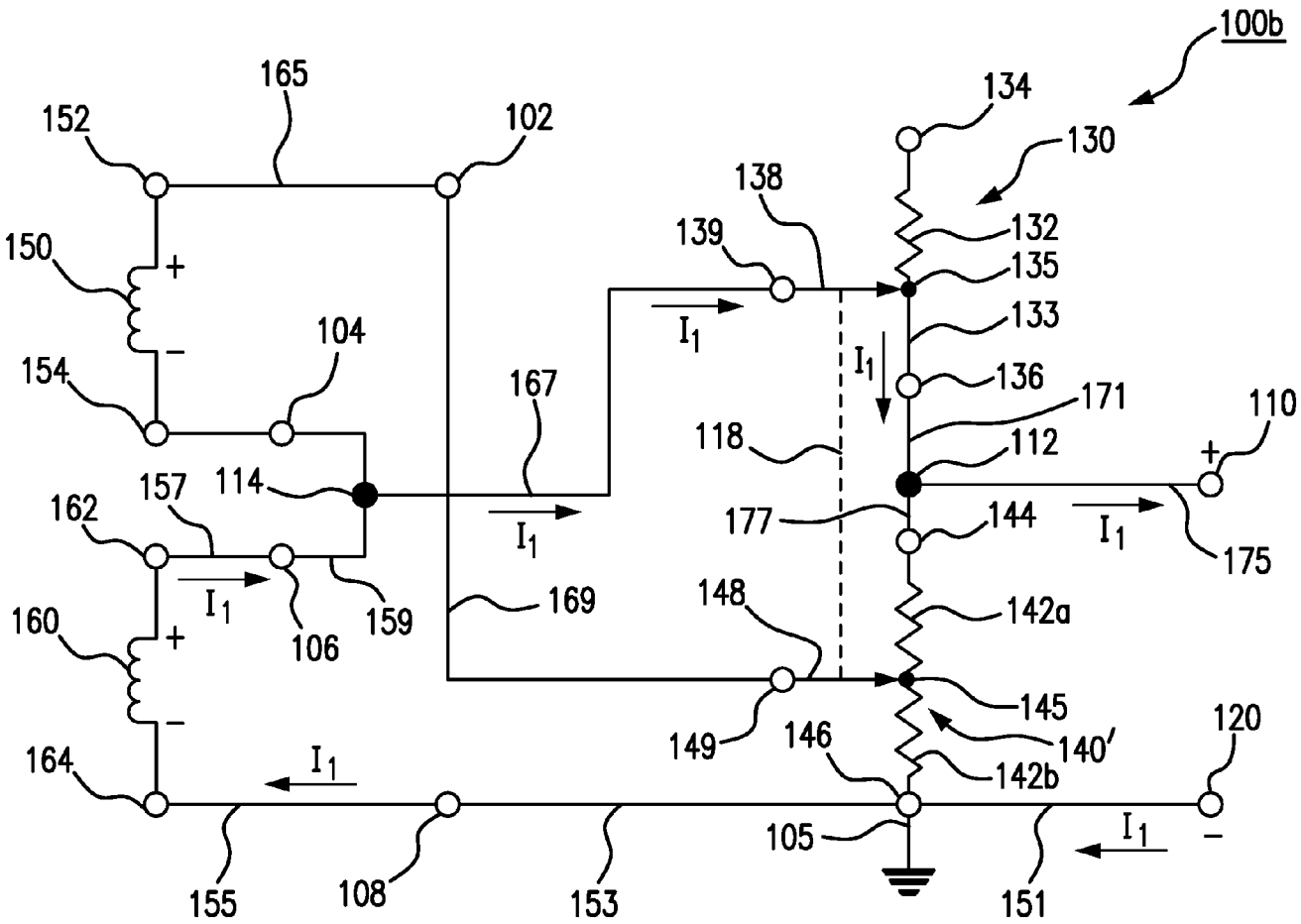
FIG. 3B is a schematic electrical diagram of the reversing configuration control with the alternate potentiometer arrangement of FIG. 3A, adjusted for a single coil configuration.
Figure 3C:
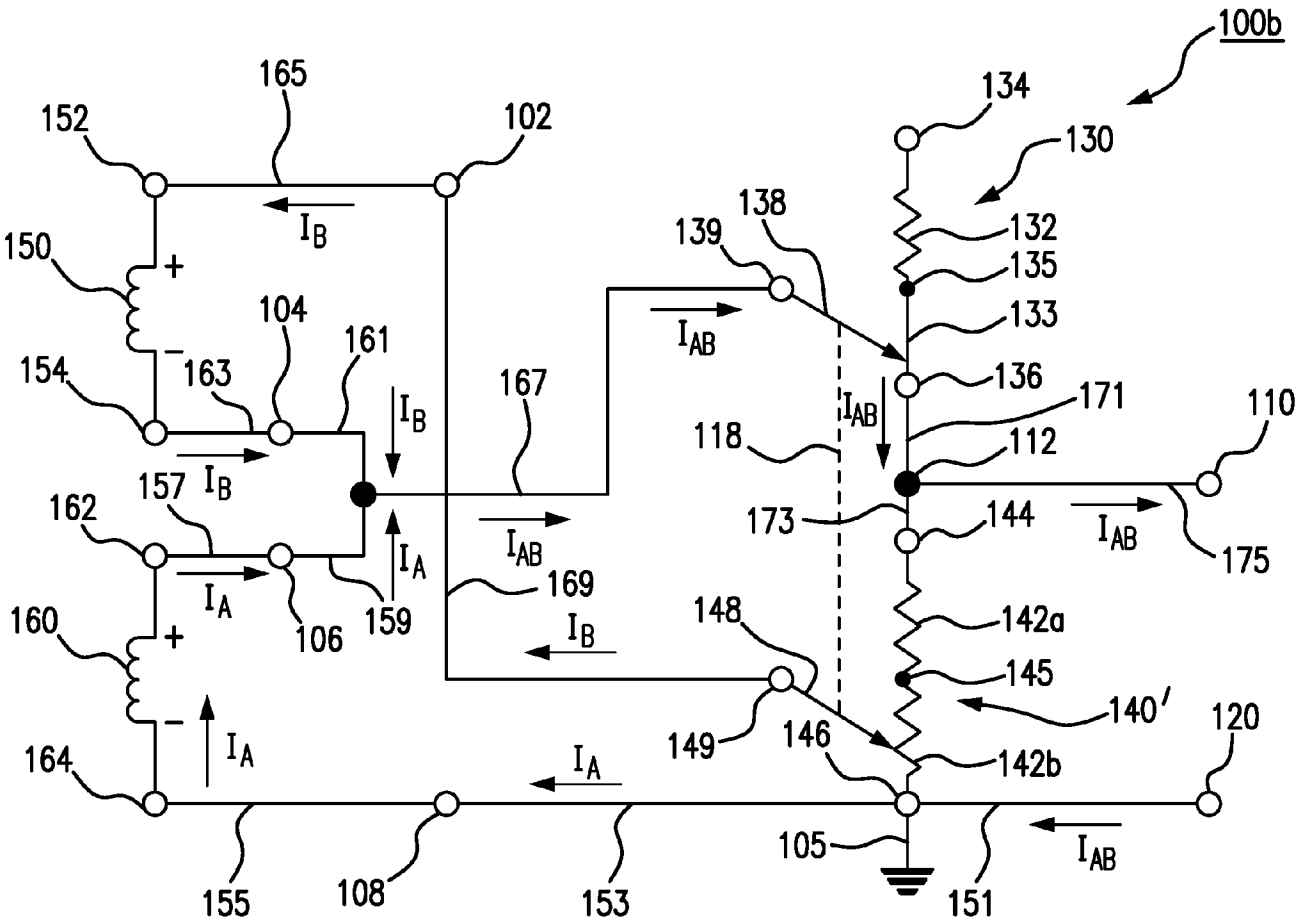
FIG. 3C is a schematic electrical diagram of the reversing configuration control with the alternate potentiometer arrangement of FIG. 3A, adjusted for a parallel configuration of pickups of opposite polarity.

Reversing configuration control 100*b*, shown in FIGS. 3A, 3B and 3C, differs from the previously described reversing configuration control 100*a* only in the use of potentiometer 140' in place of the afore described potentiometer 140. The resistance element of potentiometer 140' has a linear resistance taper where the resistance of the resistance element portions 142*a* and 142*b*, on each side of the intermediate position 145, are equivalent; each portion 142*a*, 142*b* being one half the total resistance of the resistance element.

The functionality of reversing configuration control 100*b*, as illustrated in FIGS. 3A, 3B and 3C, is identical to that which was already described with respect to reversing configuration control 100*a*. Reference numerals in common with those in FIGS. 1, 2A, 2B, and 2C represent the same elements. In FIGS. 3A and 3B, it is easy to see why the use of potentiometer 140' has no effect on the configuration provided at each of the opposing ends of the mechanical travel of the displaceable contacts 138 and 148. As for the setting of the displaceable contacts 138 and 148 of potentiometers 130 and 140' at the respective intermediate positions thereof 135 and 145, as shown in FIG. 3B, perceiving that the functionally remains the same is not immediately obvious. It will be recalled that when the displaceable contacts 138 and 148 are at the respective intermediate positions 135 and 145 of potentiometers 130 and 140, pickup coil 150 is short circuited. Whereas, potentiometer 140' of reversing configuration control 100*b* provides the resistance element portion 142*a* across the output of pickup coil 150 rather than a zero ohm portion. The resistance of resistance element portion 142*b*, albeit fifty percent of the total resistance of the resistance element, is still sufficiently high so that a negligible portion of the current $I_1$ flows therethrough from terminal 146. Likewise, the complementary resistance of resistance element portion 142*a* is equal to that of element portion 142*b* and sufficiently high so that a negligible portion of the current $I_1$ flows therethrough from terminal 149 to terminal 144. Thus, pickup coil 150 is thereby isolated from the output terminals 110 and 120 by the resistance element of potentiometer 140' of reversing configuration control 100*b* and only the output signals from the pickup coil 160 are output at terminals 110 and 120. Reversing configuration control 100*b* is particularly advantageous for use with active type pickup sensors. An active type pickup sensor incorporates a preamplifier to raise the level of the signals output therefrom and may not include short circuit protection, which would otherwise be required with use of reversing configuration control 100*a* and obviated by reversing configuration control 100*b* having the resistance of resistance element portion 142*a* coupled across the terminals of pickup coil 150.

The resistance of the resistance element portion 142*a* has softening effect on the transition between the displaceable contact positions at the intermediate position 135, 145, shown in FIG. 3B and the end position, adjacent respective terminal 134, 144, as shown in FIG. 3A. There is a reduced signal lever during such transitions as a result of the resistance of both resistance element portion 132 and resistance element portion 142*a* being in the current path.

The polarity of either of pickup coils 150 or 160 can be reversed in their connection to reversing configuration control 100*b*. Thus, the positive terminal 152 of pickup coil 150 can be connected to input terminal 104 and the negative terminal 154 thereof correspondingly connected to input terminal 102. Alternately, the positive terminal 162 of pickup coil 160 can be connected to input terminal 108 and the negative terminal 164 thereof correspondingly connected to input terminal 106. With this alternative connection scheme for one of the pickup coils, reversing configuration control 100*b* provides the pickup coils 150 and 160 in a series configuration with opposing polarity at the first end of the mechanical travel of displaceable contacts 138, 148; only the pickup coil 160 output at the intermediate position of the mechanical travel of displaceable contacts 138, 148; and provides the pickup coils 150 and 160 in a parallel configuration with like polarity at the second end of the mechanical travel of displaceable contacts 138, 148.

Figure 4A:
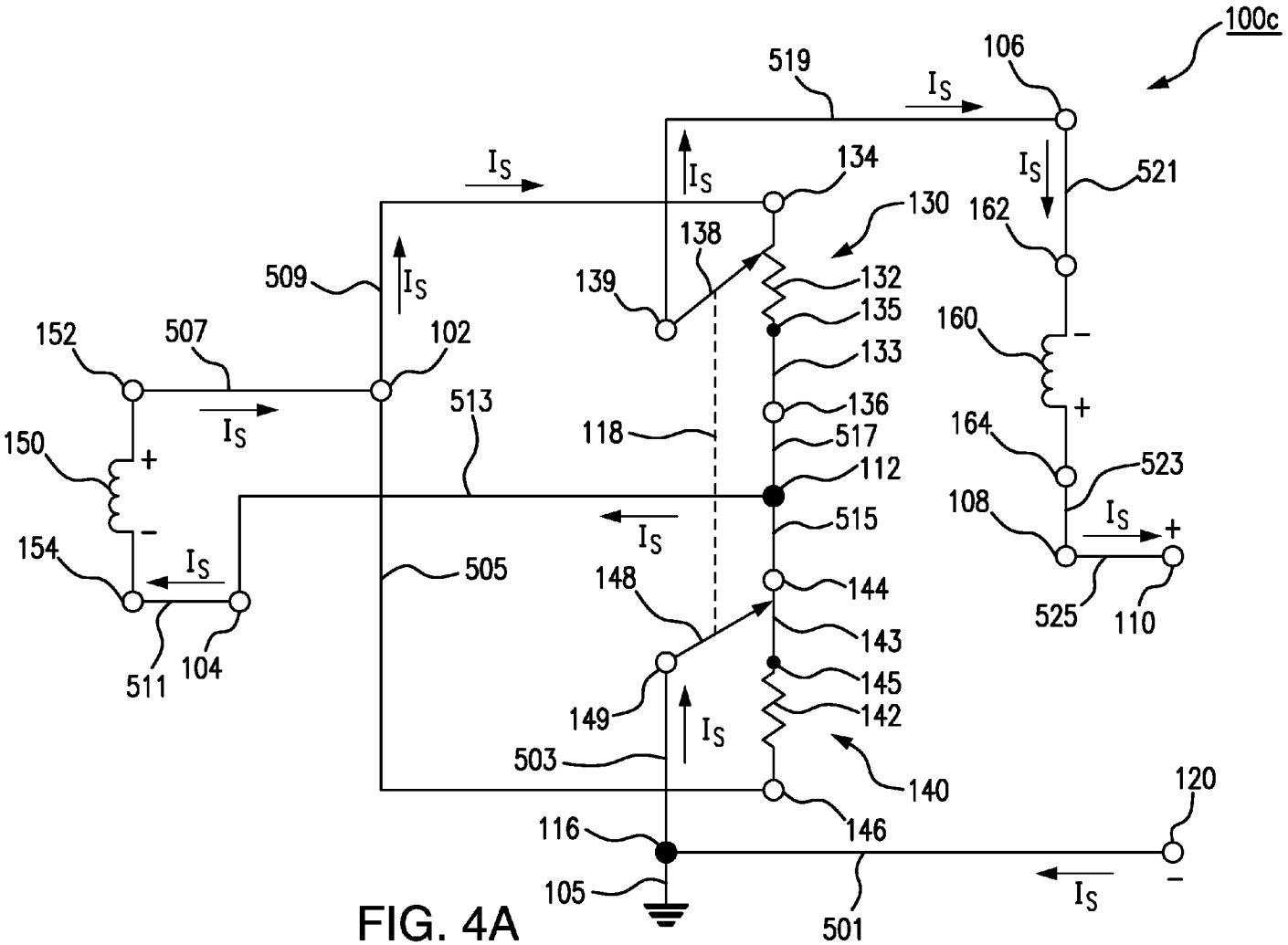
FIG. 4A is a schematic electrical diagram of another circuit arrangement of the reversing configuration control of the present invention adjusted for a series configuration of pickups of common polarity.
Figure 4B:
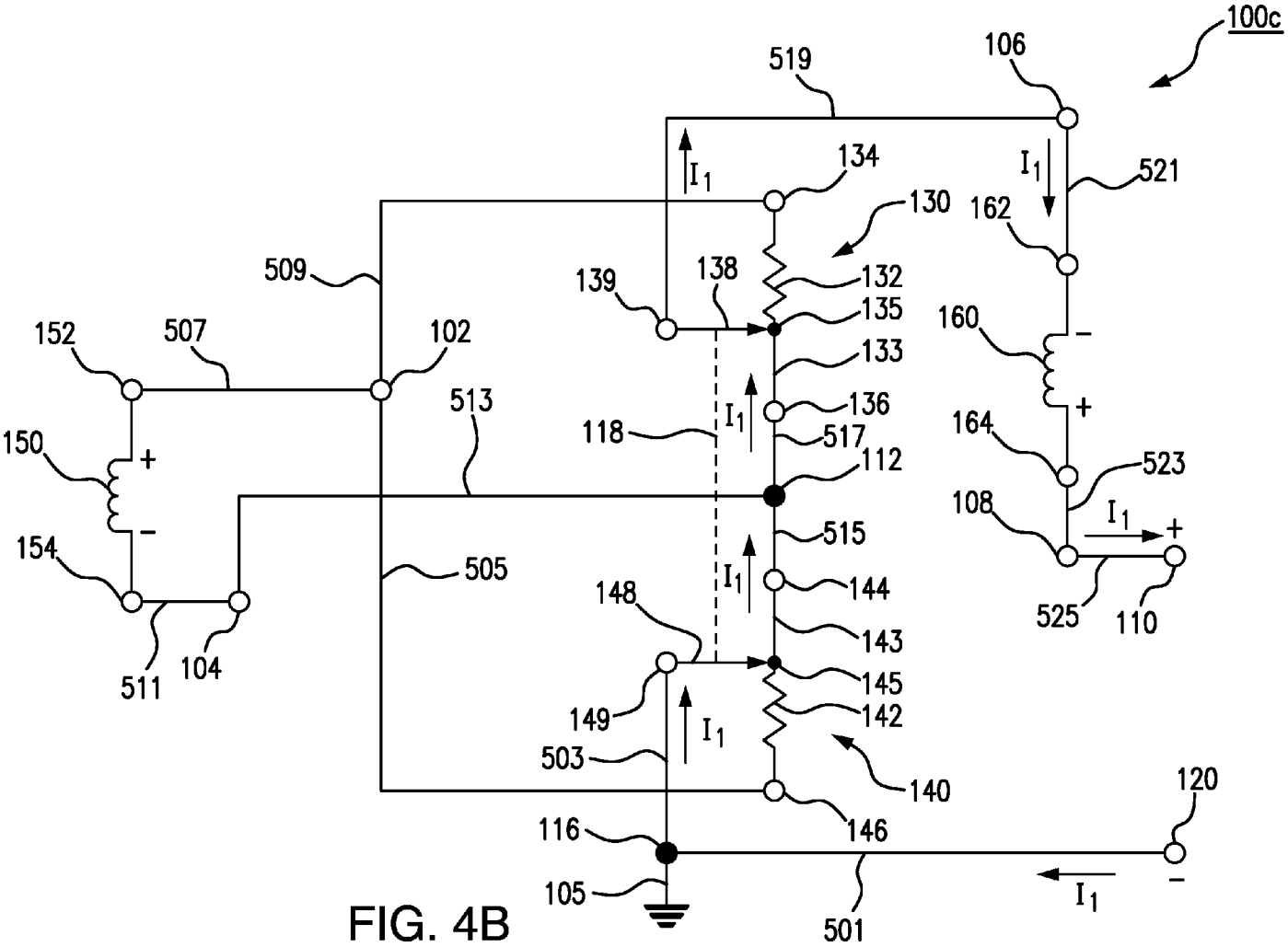
FIG. 4B is a schematic electrical diagram of the other circuit arrangement of the reversing configuration control of the present invention shown in FIG. 4A, adjusted for a single coil configuration.
Figure 4C:
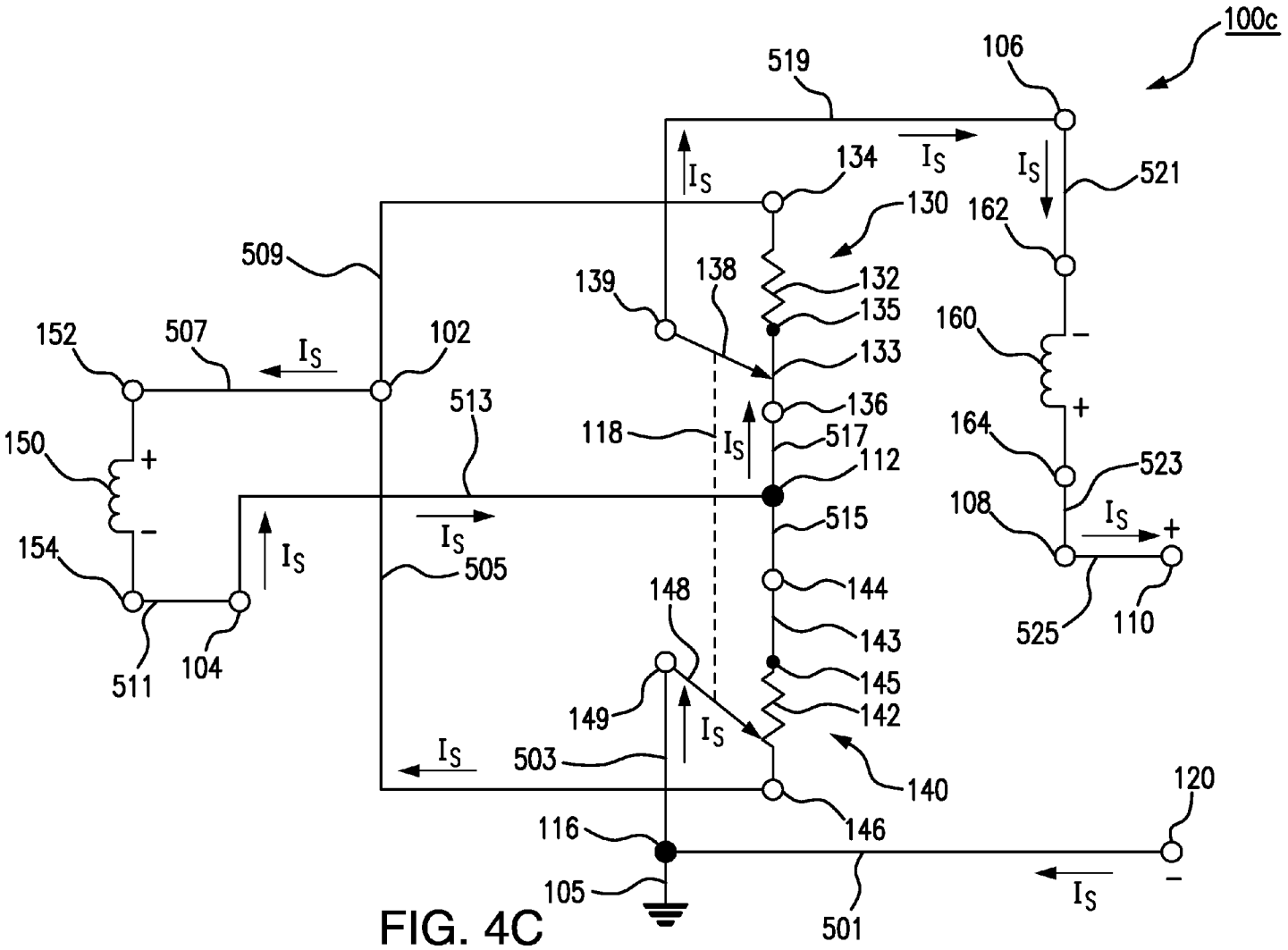
FIG. 4C is a schematic electrical diagram of the other circuit arrangement of the reversing configuration control of the present invention shown in FIG. 4A, adjusted for a series configuration of pickups of opposite polarity.

The following connections apply to reversing configuration control 100*c* shown in each of FIGS. 4A, 4B and 4C. Reference numerals in common with those in FIGS. 1, 2A, 2B, 2C, 3A, 3B, and 3C represent the same elements. Negative output terminal 120 is connected by conductor 501 to node 116, to which the ground reference 105 is also connected, and node 116 is further connected to the displaceable contact terminal 149 of potentiometer 140 by conductor 503. The terminal 146 of potentiometer 140 is connected to the input terminal 102 by conductor 505 and conductor 507 connects the positive terminal 152 of pickup coil 150 to the input terminal 102. The input terminal 102 is also coupled to terminal 134 of potentiometer 130 by the conductor 509. The negative terminal 154 of pickup coil 150 is connected to input terminal 104 by conductor 511, which is in turn connected to node 112 by conductor 513. Node 112 is connected to terminal 144 of potentiometer 140 by conductor 515 and connected to terminal 136 of potentiometer 130 by conductor 517. The displaceable contact terminal 139 is connected by conductor 519 to input terminal 106. The negative terminal 162 of pickup coil 160 is connected to input terminal 106 via conductor 521. The opposing positive terminal 164 of pickup coil 160 is connected by conductor 523 to input terminal 108, which in turn is connected by conductor 525 to positive output terminal 110.

The functioning of reversing configuration control 100*c* will now be described, beginning with the displaceable contacts 138, 148 being at a first end of their respective mechanical travel, as shown in FIG. 4A. Starting with the current $I_S$ flowing into the negative output terminal 120. The current $I_S$ flows to the displaceable contact terminal 149 of potentiometer 140 through conductor 501, node 116 and conductor 503. The current $I_S$ flows from displaceable contact terminal 149 to input terminal 104 and pickup coil 150 negative terminal 154 through the displace able contact 148, the zero ohm resistive element portion 143 of potentiometer 140, terminal 144 thereof, conductor 515, node 112 and conductor 513 to input terminal 104 and then through conductor 511. Due to the high resistance of the resistive element of potentiometer 130, no current flows from node 112 through conductor 517 to the terminal 136 of potentiometer 130.

From terminal 154, the current $I_S$ flows from the negative terminal 154 of pickup coil 150, through the pickup coil 150 to the positive terminal thereof 152 and through the conductor 507 to input terminal 102. The current Is flows from input terminal 102 to the terminal 134 of potentiometer 130 via the conductor 509. As a result of the high resistance of the resistive element portion 142 of potentiometer 140, for practical purposes, no current flows from input terminal 102 through conductor 505 to terminal 146 of potentiometer 140. From potentiometer terminal 134, the current $I_S$ flows to input terminal 106 through displaceable contact 138 to terminal 139 and through conductor 519. The current $I_S$ flows from input terminal 106 to the negative terminal 162 of pickup coil 160 via conductor 521 and through the pickup coil 160 to the positive terminal 164 thereof. The current $I_S$ flows from the positive terminal 164 to input terminal 108 through conduct 523 and flows therefrom to the positive output terminal 110 through conductor 525. Thus, it can be seen that the same current $I_S$ flows through both pickup coils 150 and 160, with the positive terminal of coil 150 connected to the negative terminal of coil 160. Accordingly, the pickup coils are connected with like polarity in series. As previously discussed, when pickup coils are coupled in series, the voltages generated in the coils is additive, but provide a higher impedance to higher frequency audio signals and hence they are said to provide a fuller and stronger sound due to the low pass filtering characteristic of that configuration.

As shown in FIG. 4B, the potentiometers 130, 140 are set at an intermediate point of their mechanical travel 135, 145, which is typically the midpoint thereof and may incorporate a mechanical detent at that position to provide a tactile indication of that position to the musician, as previously discussed. With the displaceable contacts 138 and 148 at that position, there is zero ohms resistance between terminals 139 and 136 of potentiometer 130 and for potentiometer 140 there is zero ohms resistance between terminals 149 and 144. Correspondingly, there is 100% of the resistance between terminals 149 and 146 as a result of the resistance element portion 142, and 100% of the resistance between terminals 139 and 134 as a result of the resistance element portion 132.

A current $I_1$ flows into the negative output terminal 120 to node 116 through conductor 501 and through conductor 503 to the displaceable contact terminal 149 of potentiometer 140. The current $I_1$ flows from terminal 149 through displaceable contact 148 to terminal 144 of potentiometer 140 via the zero ohm resistance element portion 143. Here again, due to the high resistance of resistance element portion 142, no current flows therethrough to the terminal 146 of potentiometer 140. From terminal 144, the current $I_1$ flows to the potentiometer terminal 136 through conductor 515, node 112 and conductor 517. As a result of both the high resistance of resistance element portion 142 and resistance element portion 132, pickup coil 150 is isolated from the current path and no current flows therethrough. The current $I_1$ flows from terminal 136 through the zero ohm resistance element portion 133 and the displaceable contact 138 to the displaceable contact terminal 139 of potentiometer 130. From terminal 139, the current $I_1$ flows to input terminal 106 through conductor 519 and through pickup coil 160, via conductor 521 and negative pickup coil terminal 162, to positive pickup coil terminal 164. The current $I_1$ flows from positive pickup coil terminal 164 to the positive output terminal 110 via the conductor 523, input terminal 108 and conductor 525. Hence, at the intermediate position of the of the travel of potentiometers 130 and 140, only the output signals from the pickup coil 160 are output at terminals 110 and 120 to provide the conventional single coil full frequency spectrum sound.

Considering displaceable contact settings intermediate the end of the displaceable contact travel shown in FIG. 4A and the position shown in FIG. 4B there is a blending of the outputs of the pickup coils 150 and 160. As the displaceable contacts 138, 148 are positioned further from the intermediate position 135, 145 toward the end of the mechanical travel shown in FIG. 4A, a greater percentage of the output of the pickup coil 150 is added in series with like polarity with that of pickup coil 160. This provides a gradual transition between the two distinct configurations and provides a greater range of sound effect variations than provided by pickup coil selection switches.

Referring now to FIG. 4C, the potentiometers 130, 140 are set with the displaceable contacts 138, 148 positioned at the opposing second end of their respective mechanical travel compared with that depicted in FIG. 4A. At the second end of the mechanical travel of displaceable contacts 138, 148, the resistance between the terminals 136 and 139, as well as between terminals 146 and 149 is zero ohms. By virtue of the displaceable contacts 138 and 148 being at the second end of the mechanical travel, the resistance between the terminals 134 and 139, as well as between terminals 144 and 149 of displaceable contacts 138, 148 is 100%. of the resistance of the corresponding resistive elements.

Starting again with the current $I_S$ flowing into the negative output terminal 120. The current $I_S$ flows to the displaceable contact terminal 149 of potentiometer 140 through conductor 501, node 116 and conductor 503. The current $I_S$ flows from displaceable contact terminal 149 to input terminal 102 and therefrom to pickup coil 150 positive terminal 152 through the displace able contact 148 of potentiometer 140, terminal 146 thereof, conductor 505 to input terminal 102 and then through conductor 507. Due to the high resistance of the resistive element of potentiometer 130, no current flows from input terminal 102 through conductor 509 to the terminal 134 of potentiometer 130.

From the positive pickup coil terminal 152, the current $I_S$ flows through the pickup coil 150 to the negative terminal thereof 154 and through the conductor 511 to input terminal 104. The current Is flows from input terminal 104 to the node 112 via the conductor 513. As a result of the high resistance of the resistive element of potentiometer 140, for practical purposes, no current flows from node 112 through conductor 515 to terminal 144 of potentiometer 140. Therefore, from node 112, the current $I_S$ flows to potentiometer terminal 136 through conductor 517, and therefrom through displaceable contact 138 to terminal 139. The current $I_S$ flows from displaceable contact terminal 139 to input terminal 106 through conductor 519. The current $I_S$ continues from input terminal 106 to the negative terminal of pickup coil 160 via conductor 521 and through the pickup coil 160 to the positive terminal 152 thereof. The current $I_S$ flows from the positive terminal 164 to input terminal 108 through conductor 523 and flows therefrom to the positive output terminal 110 through conductor 525. Thus, it can be seen that the same current $I_S$ flows through both pickup coils 150 and 160, with the negative terminal of pickup coil 150 connected to the negative terminal of pickup coil 160. Accordingly, the pickup coils are connected with the polarity of one pickup coil with respect to the other being reversed, which results in subtraction of signals (a difference signal) generated by the two coils, as a function of amplitude and phase, as previously discussed.

Now considering displaceable contact settings intermediate the end of the displaceable contact travel shown in FIG. 4*c* and the position shown in FIG. 4B there is a blending of the outputs of the pickup coils 150 and 160, with the effect of pickup coil 150 being gradually diminished as the displaceable contact 148 is moved toward the intermediate position 145, due to the increase in resistance between displaceable contact 148 and terminal 146. The decreasing complementary resistance between displaceable contact 148 and terminal 144 creates a current path through pickup coil 150 in opposition to the current $I_S$ that flows therethrough when the displaceable contact was positioned at the end position shown in FIG. 4C to thereby reduce the contribution of the pickup coil 150 to the output at terminals 110, 120. The displacement of displaceable contact 138 does not affect this blending effect since it remains in contact with the zero ohm resistance element portion 133 throughout that displacement. Accordingly, as the amplitude of the signals generated by pickup coil 150 are reduced, so too is the signal cancellation effect. This provides a gradual transition between the two distinct configurations and again provides a greater range of sound effect variations than provided by pickup coil selection switches.

Figure 5A:
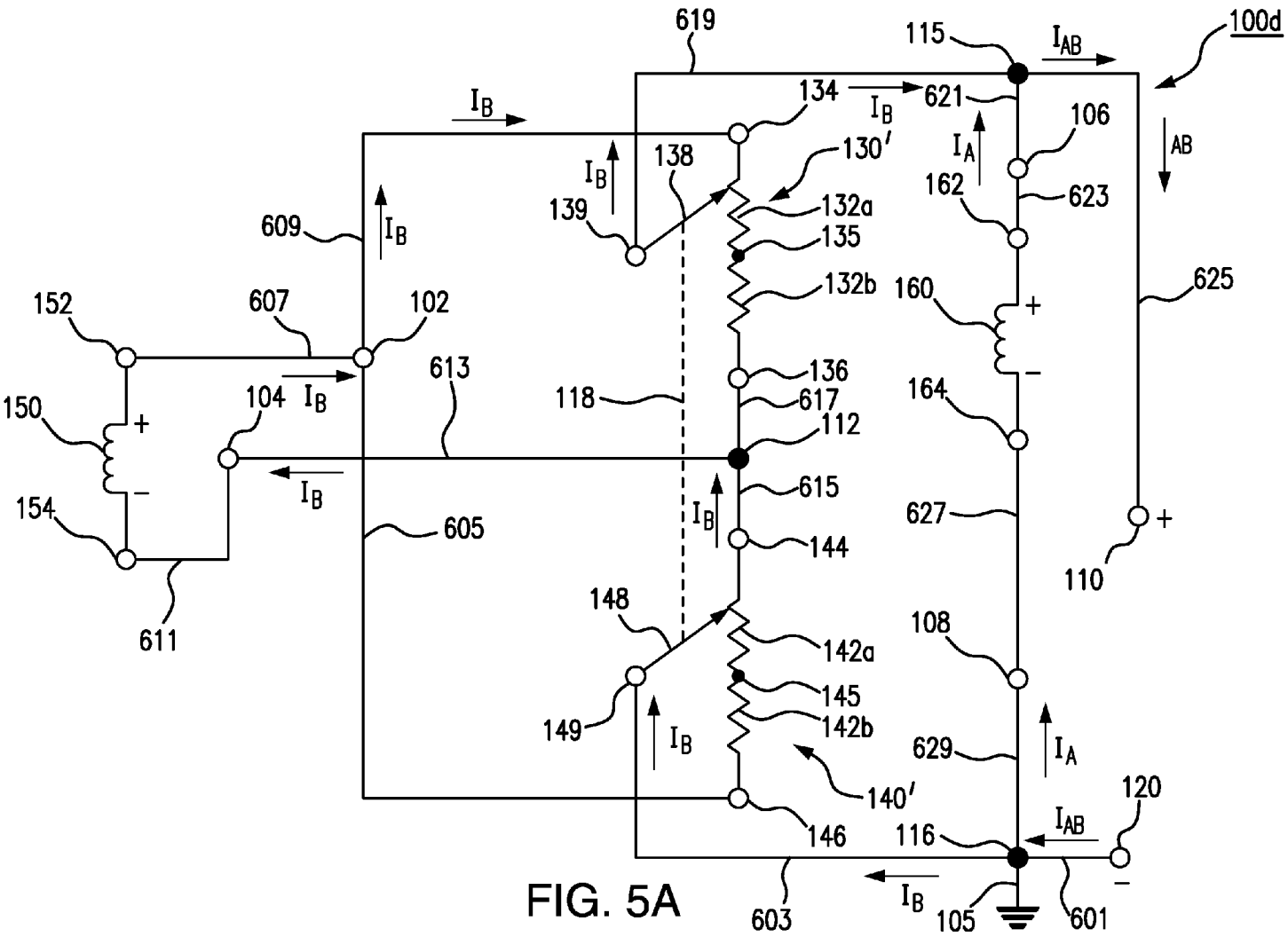
FIG. 5A. is a schematic electrical diagram of a further circuit arrangement of the reversing configuration control of the present invention adjusted for a parallel configuration of pickups of common polarity.
Figure 5B:
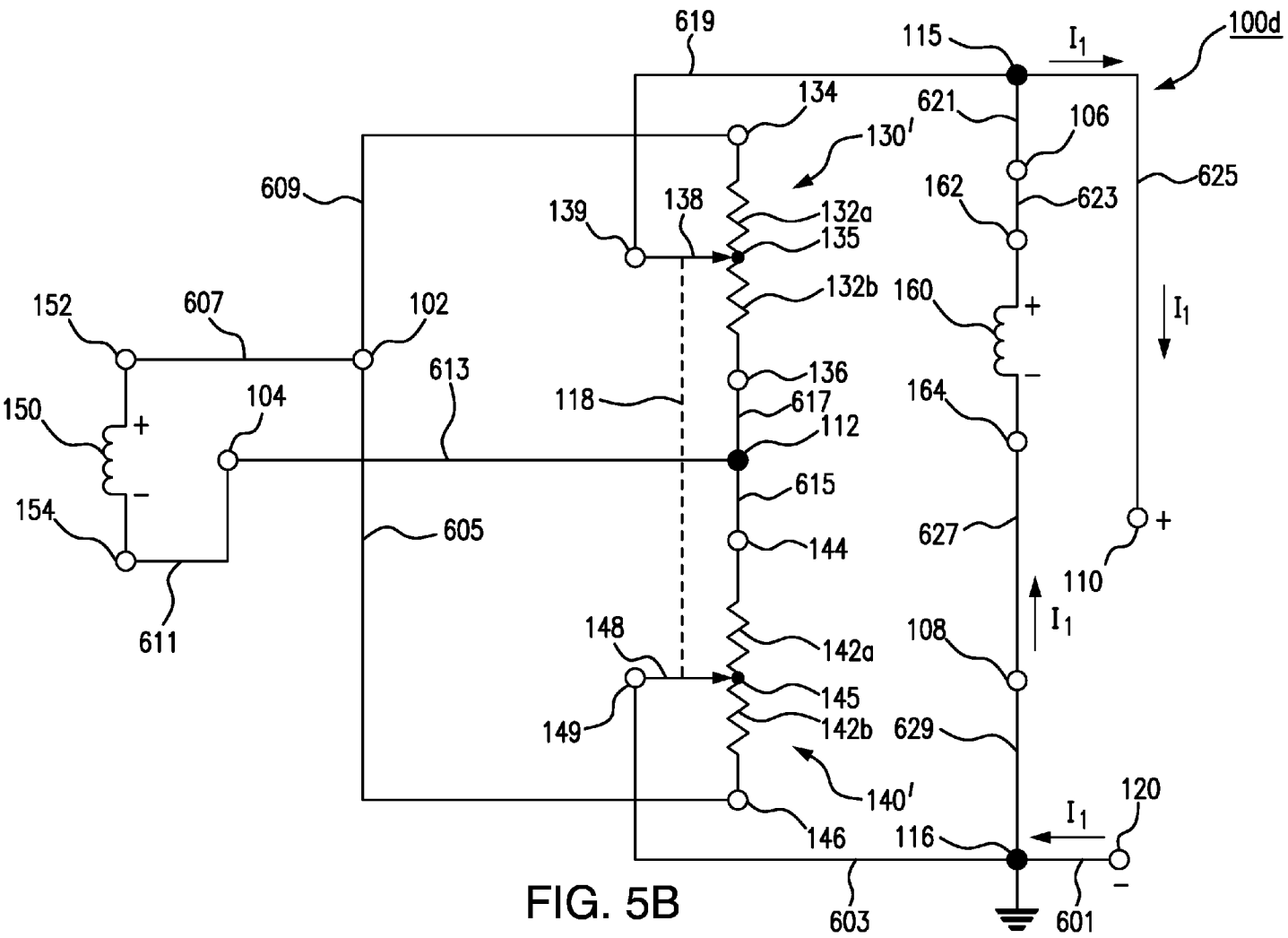
FIG. 5B is a schematic electrical diagram of the further circuit arrangement of the reversing configuration control of the present invention shown in FIG. 5A, adjusted for a single coil configuration.
Figure 5C:
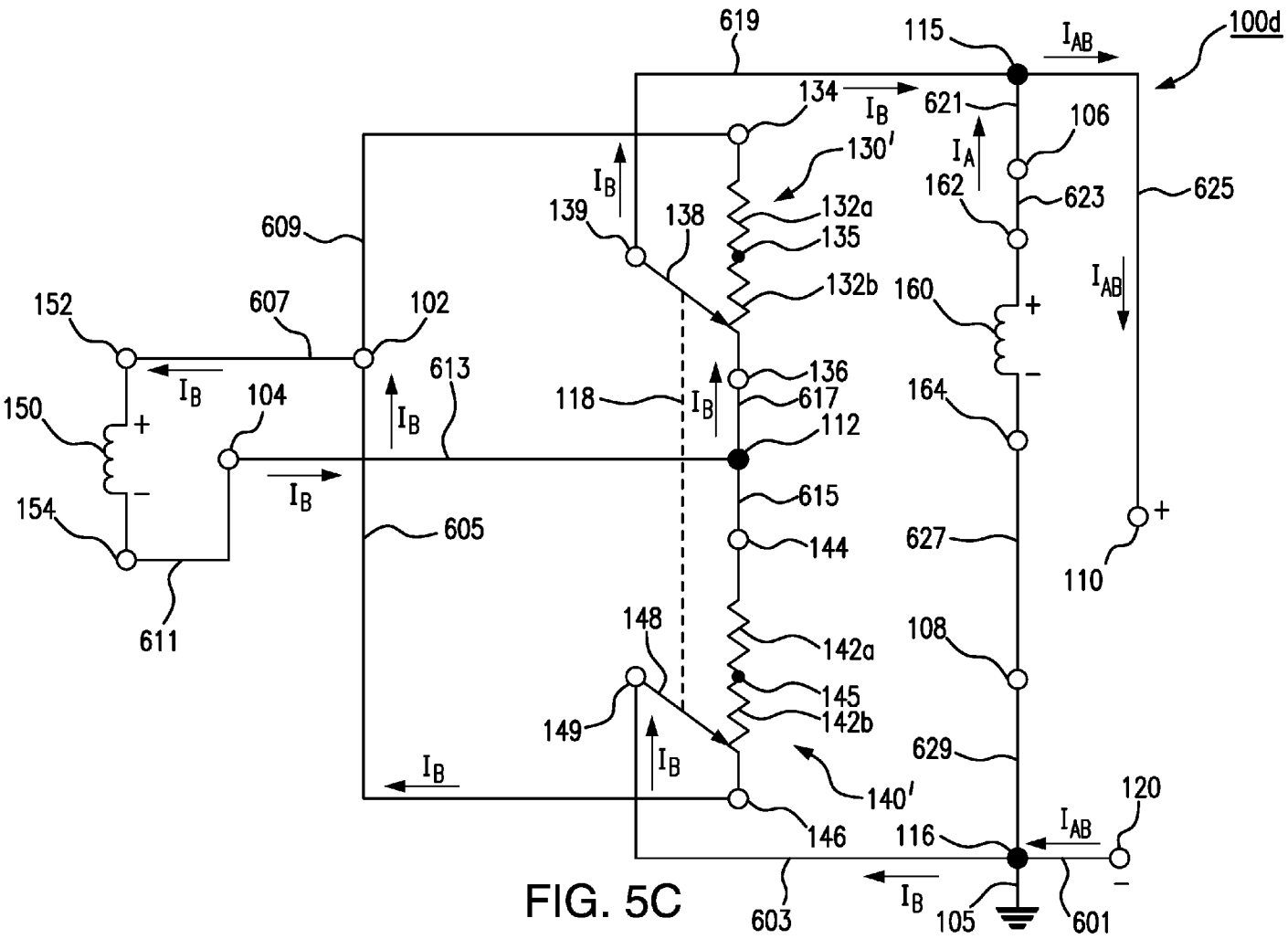
FIG. 5C is a schematic electrical diagram of the further circuit arrangement of the reversing configuration control of the present invention shown in FIG. 5A, adjusted for a parallel configuration of pickups of opposite polarity.

The following connections apply to reversing configuration control 100*d* shown in each of FIGS. 5A, 5B and 5C. Reference numerals in common with those in FIGS. 1, 2A, 2B, 2C, 3A, 3B, 3C, 4A, 4B, and 4C represent the same elements. Negative output terminal 120 is connected by conductor 601 to node 116, to which the ground reference 105 is also connected, and node 116 is further connected to the displaceable contact terminal 149 of potentiometer 140' by conductor 603. The terminal 146 of potentiometer 140' is connected to the input terminal 102 by conductor 605 and conductor 607 connects the positive terminal 152 of pickup coil 150 to the input terminal 102. The input terminal 102 is also coupled to terminal 134 of potentiometer 130' by the conductor 609. The negative terminal 154 of pickup coil 150 is connected to input terminal 104 by conductor 611, which is in turn connected to node 112 by conductor 613. Node 112 is connected to terminal 144 of potentiometer 140' by conductor 615 and connected to terminal 136 of potentiometer 130' by conductor 617. The displaceable contact terminal 139 is connected by conductor 619 to node 115. Node 115 is connected to both positive output terminal 110, by conductor 625, and input terminal 106 by conductor 621. The negative terminal 162 of pickup coil 160 is connected to input terminal 106 by conductor 623. The opposing positive terminal 164 of pickup coil 160 is connected to input terminal 108, by conductor 627, which in turn is connected by conductor 629 to node 116.

Reversing configuration control 100*d* utilizes potentiometers 130' and 140' that are mechanically coupled for concurrent displaceable contact movement, as illustrated by the coupling line 118. Potentiometers 130' and 140' are identical to one another and have respective non-zero resistance element portions 132*a* and 132*b*, 142*a* and 142*b*. As previously discussed with respect to the potentiometer 140' used in reversing configuration control 100*b* the resistance elements have linear tapers. In working embodiments, potentiometers 130' and 140' were implemented as rotary type dual-gang potentiometers available from Bourns, Inc. of Riverside, Calif. and have the designation PDB182-K420K-504B with resistive elements thereof being 250Ω. Similarly constructed dual-gang potentiometers are available from a multitude of manufacturers and well known in the art.

The functioning of reversing configuration control 100*d* will now be described, beginning with the displaceable contacts 138, 148 being at a first end of their respective mechanical travel, as shown in FIG. 5A. Beginning at negative output terminal 120, the current $I_{AB}$ flows to node 116 through the conductor 601. At node 116 the current $I_{AB}$ divides into a current $I_A$ flowing to input terminal 108 via conductor 629 and a current $I_B$ flowing to displaceable contact terminal 149 of potentiometer 140' through the conductor 603. The current $I_A$ flows from input terminal 108 to the negative terminal 164 of pickup coil 160 via conductor 627, and through that pickup coil 160 to positive pickup coil terminal 162. From terminal 162, the current $I_A$ flows to the node 115 through conductor 623, input terminal 106 and the conductor 621. The current $I_B$ flows from displaceable contact terminal 149 to node 112 via the displaceable contact 148, terminal 144 and conductor 615. As should now be well understood, no current flows from displaceable contact 148 to terminal 146 due to the high resistance of the resistive element of potentiometer 140'. Likewise, no current flows from node 112 to the terminal 136 due to the high resistance of the resistive element of potentiometer 130'.

The current $I_B$ flows from node 112 to the negative terminal 154 of pickup coil 150 via the conductor 613, input terminal 104 and the conductor 611. The current $I_B$ flows through pickup coil 150, to the positive terminal 152 thereof and from there through input terminal 102 and conductor 609 to terminal 134 of potentiometer 134. From terminal 134, the current $I_B$ flows through the displaceable contact 138, terminal 139 and conductor 619 to the node 115 where it is combined with the current $I_A$ to form the current $I_{AB}$. The current $I_{AB}$ flows from node 115 through the conductor 625 to the positive output terminal 110. As the negative terminals 154 and 164 of the corresponding pickup coils 150 and 160 are electrically coupled in common to the negative output terminal 120, and the associated positive terminals 152 and 162 are likewise electrically coupled in common to the positive output terminal 110, such defines a parallel circuit configuration of pickup coils 150 and 160. Further, it can be seen that both pickup coils 150 and 160 have like polarity. Thus, the parallel arrangement of pickup coils 150 and 160 with like polarity produces a brighter sound due to the known effect of reduced high frequency impedance compared to a series configuration thereof. The parallel configuration of pickup coils also results in a lower voltage than that produced by series coupled pickup coils.

As shown in FIG. 5B, the potentiometers 130', 140' are set at an intermediate point of their mechanical travel 135, 145, which is typically the midpoint thereof and may incorporate a mechanical detent at that position to provide a tactile indication of that position to the musician, as discussed previously. With the displaceable contacts 138 and 148 at that position, there is a substantial resistance between each displaceable contact 138 and 148 and each of the corresponding potentiometer terminals 134, 136 and 144, 146 due to the resistance element portions 132*a*, 132*b* and 142*a*, 142*b* connected therebetween. Thus, the pickup coil 150 is isolated from the output terminals 110 and 120 by a high enough resistance to prevent current flow therethrough, for practical purposes considering the signal levels involved.

A current $I_1$ flows into the negative output terminal 120 to node 116 through conductor 601 and through conductor 629 to the input terminal 108. No current flows from node 116 through conductor 603 due the resistance of each of resistance element portions 142*a* and 142*b* of potentiometer 140'. From input terminal 108 the current $I_1$ flows through pickup coil 160 via conductor 627, and negative pickup coil terminal 164, to flow to positive pickup coil terminal 162. The current $I_1$ flows from terminal 162 to input terminal 106 via conductor 623, and therefrom to node 115 via conductor 621. No current flows to or from node 115 through conductor 619 due the resistance of each of resistance element portions 132*a* and 132*b* of potentiometer 130'. From node 115, the current $I_1$ flows to positive output terminal 110 through the conductor 625. Thus, at the intermediate position of the of the travel 135, 145 of potentiometers 130' and 140' of reversing configuration control 100*d*, only the output signals from the pickup coil 160 are output at terminals 110 and 120 to provide the conventional single coil full frequency spectrum sound.

Hereto, in considering displaceable contact settings intermediate the end of the displaceable contact travel shown in FIG. 5A and the position shown in FIG. 5B there is a blending of the outputs of the pickup coils 150 and 160. As the displaceable contacts 138, 148 are positioned further from the intermediate position 135, 145 toward the end of the mechanical travel shown in FIG. 5A, a greater percentage of the output of the pickup coil 150 is added in parallel and like polarity with that of pickup coil 160. This provides a gradual transition between the two distinct configurations and provides a greater range of sound effect variations than provided by pickup coil selection switches.

Referring now to FIG. 5C, the potentiometers 130', 140' are set with the displaceable contacts 138, 148 positioned at the opposing second end of their respective mechanical travel. Beginning at negative output terminal 120, the current $I_{AB}$ flows to node 116 via conductor 601. At node 116 the current $I_{AB}$ divides into a current $I_A$ that flows to the node 115 as was previously described with respect to FIG. 5A. and a current $I_B$ flowing to displaceable contact terminal 149 of potentiometer 140' through the conductor 603. The current $I_B$ flows from displaceable contact terminal 149 to input terminal 102 via the displaceable contact 148, terminal 146 and conductor 605. As should now be well understood, no current flows from displaceable contact 148 to terminal 144 due to the high resistance of the resistive element of potentiometer 140'.

The current $I_B$ flows from input terminal 102 to the positive terminal 152 of pickup coil 150 via the conductor 607. The current $I_B$ flows through pickup coil 150, to the negative terminal 154 thereof, then through conductor 611 to input terminal 104, and therefrom through conductor 613 to node 112. The current $I_B$ flows from node 112 to terminal 136 of potentiometer 130' through conductor 617. No current flows from node 112 to the terminal 144 via conductor 615 due to the high resistance of the resistive element of potentiometer 140'. Therefore, the current $I_B$ flows to the displaceable contact terminal 139 through the displaceable contact 138. From, terminal 139 the current $I_B$ flows through conductor 619 to the node 115 where it is combined with the current $I_A$ to form the current $I_{AB}$. The current $I_{AB}$ flows through the conductor 625 to the positive output terminal 110. As the negative terminal 154 of pickup coil 150 is electrically coupled in common with the positive terminal 162 of pickup coil 160 to positive output terminal 120, and the positive terminal 152 of pickup coil 150 is electrically coupled in common with the negative terminal 164 of pickup coil 160 to the negative output terminal 120, such defines a parallel circuit configuration of pickup coils 150 and 160, but with the pickup coils being connected with the polarity of one pickup coil with respect to the other being reversed. Hence, this parallel configuration of pickup coils results in subtraction of signals generated by the two coils, as a function of their amplitude and phase, just as results in the series pickup coil configurations with the coils having opposing polarities, as previously discussed.

At intermediate positions of the displaceable contact travel between the end position shown in FIG. 5C and the position shown in FIG. 5B there is a blending of the outputs of the pickup coils 150 and 160, with the effect of pickup coil 150 being gradually diminished as both displaceable contacts 138, 148 are moved toward the corresponding intermediate positions 135, 145, due to the increase in resistance between the respective displaceable contacts 138, 148 and associated terminals 136, 146 to thereby reduce the contribution of the pickup coil 150 to the output at terminals 110, 120. Accordingly, as the amplitude of the signals generated by pickup coil 150 are reduced, so too is the signal cancellation effect. This provides a gradual transition between the two distinct configurations and again provides a greater range of sound effect variations than provided by pickup coil selection switches.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features, and in certain cases, particular locations of elements may be reversed or interposed, all without departing from the spirit or scope of the invention as defined in the appended Claims. The scope of the invention should therefore be determined with reference to the description above, the appended claims and drawings, along with their full range of equivalents.

What is being claimed is:

1. A reversing configuration control for string instruments having at least a pair of pickup coils, comprising:
   a pair of output terminals;
   a respective pair of input terminals coupled to each of the pair of pickup coils; and
   a pair of potentiometers each having a displaceable contact, said pair of potentiometers being mechanically coupled for concurrent mechanical travel of said displaceable contacts thereof, at least one of said pair of potentiometers being coupled to one of said pair of output terminals and at least one of said displaceable contacts being coupled to one of said input terminals, said pair of potentiometers providing selective operative coupling of the pair of pickup coils to said output terminals responsive to a position of said displaceable contacts with respect to said mechanical travel thereof, wherein said selective operative coupling includes (a) the pair of pickup coils being coupled with like polarity in one of series or parallel to said output terminals, or (b) coupling only one of the pair of pickup coils to said output terminals, or (c) the pair of pickup coils being coupled with opposing polarity in one of series or parallel to said output terminals.

2. The reversing configuration control for string instruments as recited in claim 1, where the selective operative coupling of only one of the pair of pickup coils to said output terminals provided by said pair of potentiometers is an intermediate position of said displaceable contacts with respect to said mechanical travel thereof.

3. The reversing configuration control for string instruments as recited in claim 2, where said one pickup coil coupled to said output terminals is a bridge pickup coil.

4. The reversing configuration control for string instruments as recited in claim 2, where said pair of potentiometers has a detent at said intermediate position of said mechanical travel of said displaceable contacts to provide a tactile indication thereof.

5. The reversing configuration control for string instruments as recited in claim 1, where at least another of said input terminals is coupled to one of said output terminals.

6. The reversing configuration control for string instruments as recited in claim 1, where the other of said displaceable contacts is coupled to said one of said pair of output terminals.

7. The reversing configuration control for string instruments as recited in claim 1, where one input terminal of each of said pair of input terminals are connected together and one of said displaceable contacts is coupled to said interconnected input terminals.

8. The reversing configuration control for string instruments as recited in claim 7, where said selective operative coupling includes (a) the pair of pickup coils being coupled with like polarity in series to said output terminals, or (b) coupling only one of the pair of pickup coils to said output terminals, or (c) the pair of pickup coils being coupled with opposing polarity in series to said output terminals.

9. The reversing configuration control for string instruments as recited in claim 1, where both of said displaceable contacts are coupled to a respective one of said input terminals.

10. The reversing configuration control for string instruments as recited in claim 1, where both of said displaceable contacts are coupled to a respective one of said pair of output terminals.

11. The reversing configuration control for string instruments as recited in claim 2, where each of said pair of potentiometers has a variable resistance that varies from 0% to 100% between said intermediate position and one end position of said mechanical travel of said displaceable contact and a resistance that remains at 0% between said intermediate position of said mechanical travel and an opposing end position of said mechanical travel.

12. The reversing configuration control for string instruments as recited in claim 11, where said variable resistance of a first of said pair of potentiometers is disposed between said intermediate position and a first end position of said mechanical travel of said displaceable contact thereof, and said variable resistance of a second of said pair of potentiometers is disposed between said intermediate position and a second end position of said mechanical travel of said displaceable contact thereof.

13. The reversing configuration control for string instruments as recited in claim 2, where one of said pair of potentiometers has a variable resistance that varies from 0% to 100% between said intermediate position and one end position of said mechanical travel of said displaceable contact and a resistance that remains at 0% between said intermediate position of said mechanical travel and an opposing end position of said mechanical travel, and the other of said pair of potentiometers has a variable resistance that respectively varies from 0% to 50% between said intermediate position and each end position of said mechanical travel of said displaceable contact.

14. The reversing configuration control for string instruments as recited in claim 2, where each of said pair of potentiometers has a variable resistance that respectively varies from 0% to 50% between said intermediate position and each end position of said mechanical travel of said displaceable contact, said substantial resistance having a linear taper.

15. The reversing configuration control for string instruments as recited in claim 14, where said selective operative coupling includes (a) the pair of pickup coils being coupled with like polarity in parallel to said output terminals, or (b)

coupling only one of the pair of pickup coils to said output terminals, or (c) the pair of pickup coils being coupled with opposing polarity in parallel to said output terminals.

16. The reversing configuration control for string instruments as recited in claim 2, where each of said pair of potentiometers has a variable resistance that respectively varies from 0% to 50% between said intermediate position and each end position of said mechanical travel of said displaceable contact, said substantial resistance having a logarithmic taper.

17. The reversing configuration control for string instruments as recited in claim 16, where said selective operative coupling includes (a) the pair of pickup coils being coupled with like polarity in parallel to said output terminals, or (b) coupling only one of the pair of pickup coils to said output terminals, or (c) the pair of pickup coils being coupled with opposing polarity in parallel to said output terminals.

18. A reversing configuration control for string instruments, comprising:

a pair of pickup coils;

a pair of output terminals;

a respective pair of input terminals coupled to each of said pair of pickup coils; and a pair of potentiometers each having a displaceable contact, said pair of potentiometers being mechanically coupled for concurrent mechanical travel of said displaceable contacts thereof, at least one of said pair of potentiometers being coupled to one of said pair of output terminals and at least one of said displaceable contacts being coupled to one of said input terminals, said pair of potentiometers providing selective operative coupling of said pair of pickup coils to said output terminals responsive to a position of said displaceable contacts with respect to said mechanical travel thereof, wherein said selective operative coupling includes (a) said pair of pickup coils being coupled with like polarity in one of series or parallel to said output terminals, or (b) coupling only one of said pair of pickup coils to said output terminals, or (c) said pair of pickup coils being coupled with opposing polarity in one of series or parallel to said output terminals.

19. The reversing configuration control for string instruments as recited in claim 18, where the selective operative coupling of only one of the pair of pickup coils to said output terminals provided by said pair of potentiometers is an intermediate position of said displaceable contacts with respect to said mechanical travel thereof.

20. The reversing configuration control for string instruments as recited in claim 18, where both of said displaceable contacts are coupled to a respective one of said input terminals.

21. The reversing configuration control for string instruments as recited in claim 18, where both of said displaceable contacts are coupled to a respective one of said pair of output terminals.

* * * * *